US009478227B2

(12) United States Patent
Choo et al.

(10) Patent No.: US 9,478,227 B2
(45) **Date of Patent: *Oct. 25, 2016**

(54) METHOD AND APPARATUS FOR ENCODING AND DECODING HIGH FREQUENCY SIGNAL

(71) Applicant: SAMSUNG ELECTRONICS CO., LTD., Suwon-si, Gyeonggi-do (KR)

(72) Inventors: Ki-hyun Choo, Seoul (KR); Lei Miao, Beijing (CN); Eun-mi Oh, Seongnam (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/474,220

(22) Filed: Sep. 1, 2014

(65) Prior Publication Data

US 2014/0372108 A1 Dec. 18, 2014

Related U.S. Application Data

(63) Continuation of application No. 13/858,688, filed on Apr. 8, 2013, now Pat. No. 8,825,476, which is a continuation of application No. 13/354,749, filed on Jan. 20, 2012, now Pat. No. 8,417,516, which is a continuation of application No. 11/984,315, filed on Nov. 15, 2007, now Pat. No. 8,121,832.

(30) Foreign Application Priority Data

Nov. 17, 2006 (KR) ..... 10-2006-0113904
Nov. 22, 2006 (KR) ..... 10-2006-0116045

(51) Int. Cl.
*G10L 19/00* (2013.01)
*G10L 19/06* (2013.01)
(Continued)

(52) U.S. Cl.
CPC ..... *G10L 19/06* (2013.01); *G10L 19/02* (2013.01); *G10L 19/0208* (2013.01);
(Continued)

(58) Field of Classification Search
CPC ..... G10L 21/038; G10L 19/0208; G10L 19/097; G10L 19/24; G10L 19/038; G10L 21/0208; G10L 21/0232; G10L 15/90; G10L 25/93; G10L 19/012; G10L 19/02; G10L 19/04; G10L 19/06; G10L 19/07; G10L 19/08; G10L 19/10; G10L 19/12; G10L 19/125; G10L 19/18; G10L 19/22; G10L 2025/786; G10L 25/12
USPC ..... 704/219, 210, 222, 230, 200.1, 206, 704/207, 208, 223, 225, 262, 500, 501, 502
See application file for complete search history.

(56) References Cited

U.S. PATENT DOCUMENTS 5,794,180 A 8/1998 McCree
5,806,027 A 9/1998 George et al.
(Continued)

FOREIGN PATENT DOCUMENTS

CN 1337043 2/2002
CN 1527995 9/2004
(Continued)

OTHER PUBLICATIONS

Korean Office Action dated Dec. 13, 2013 from Korean Patent Application No. 10-2007-0116151, (7 pp.).
(Continued)

*Primary Examiner* — Vijay B Chawan
(74) *Attorney, Agent, or Firm* — Sughrue Mion, PLLC

(57) ABSTRACT

Provided are a method and apparatus for encoding and decoding a high frequency signal by using a low frequency signal. The high frequency signal can be encoded by extracting a coefficient by linear predicting a high frequency signal, and encoding the coefficient, generating a signal by using the extracted coefficient and a low frequency signal, and encoding the high frequency signal by calculating a ratio between the high frequency signal and an energy value of the generated signal. Also, the high frequency signal can be decoded by decoding a coefficient, which is extracted by linear predicting a high frequency signal, and a low frequency signal, and generating a signal by using the decoded coefficient and the decoded low frequency signal, and adjusting the generated signal by decoding a ratio between the generated signal and an energy value of the high frequency signal.

18 Claims, 12 Drawing Sheets

(51) Int. Cl.

| | |
|---|---|
| ***G10L 19/02*** | (2013.01) |
| ***G10L 21/038*** | (2013.01) |
| ***G10L 19/04*** | (2013.01) |
| ***G10L 19/07*** | (2013.01) |
| ***G10L 25/12*** | (2013.01) |
| ***G10L 25/90*** | (2013.01) |

(52) U.S. Cl.
CPC ..... *G10L 19/04* (2013.01); *G10L 19/07* (2013.01); *G10L 21/038* (2013.01); *G10L 25/12* (2013.01); *G10L 25/90* (2013.01)

(56) References Cited

U.S. PATENT DOCUMENTS

| | | | | |
|---|---|---|---|---|
| 5,890,108 | A * | 3/1999 | Yeldener | G10L 19/18 704/200.1 |
| 5,896,176 | A | 4/1999 | Das et al. | |
| 5,966,689 | A | 10/1999 | McCree | |
| 5,978,759 | A | 11/1999 | Tsushima et al. | |
| 6,003,000 | A | 12/1999 | Ozzimo et al. | |
| 6,122,608 | A | 9/2000 | McCree | |
| 6,233,550 | B1 | 5/2001 | Gersho et al. | |
| 6,377,916 | B1 | 4/2002 | Hardwick | |
| 6,675,144 | B1 | 1/2004 | Tucker et al. | |
| 6,691,092 | B1 | 2/2004 | Udaya Bhaskar et al. | |
| 6,772,114 | B1 | 8/2004 | Sluijter et al. | |
| 6,931,373 | B1 * | 8/2005 | Bhaskar | G10L 19/08 704/219 |
| 6,996,523 | B1 | 2/2006 | Bhaskar et al. | |
| 7,013,269 | B1 * | 3/2006 | Bhaskar | G10L 19/097 704/219 |
| 7,430,506 | B2 | 9/2008 | Nam et al. | |
| 7,848,921 | B2 | 12/2010 | Ehara | |
| 8,078,474 | B2 * | 12/2011 | Vos | G10L 19/0208 704/500 |
| 8,108,222 | B2 | 1/2012 | Tsushima et al. | |
| 8,121,832 | B2 | 2/2012 | Choo et al. | |
| 8,417,516 | B2 | 4/2013 | Choo et al. | |
| 8,725,499 | B2 * | 5/2014 | Rajendran | G10L 19/012 704/210 |
| 2004/0111257 | A1 | 6/2004 | Sung et al. | |
| 2007/0299669 | A1 | 12/2007 | Ehara | |
| 2008/0027717 | A1 * | 1/2008 | Rajendran | G10L 21/038 704/210 |
| 2008/0126086 | A1 * | 5/2008 | Vos | G10L 19/0208 704/225 |
| 2009/0319262 | A1 * | 12/2009 | Gupta | G10L 25/90 704/207 |
| 2009/0319292 | A1 | 12/2009 | Warner et al. | |
| 2013/0226597 | A1 | 8/2013 | Kjoerling et al. | |
| 2014/0372108 | A1 * | 12/2014 | Choo | G10L 19/0208 704/205 |

FOREIGN PATENT DOCUMENTS

| | | |
|---|---|---|
| JP | 2005-510772 | 4/2005 |
| KR | 2003-0072060 | 9/2003 |
| KR | 10-2004-0050141 A | 6/2004 |
| WO | WO 2006/107840 | 10/2006 |

OTHER PUBLICATIONS

First Office Action, mailed Feb. 16, 2011, in corresponding Chinese Application No. 200710192804.6 (42 pp.).
Second Office Action, mailed Aug. 23, 2011, in corresponding Chinese Application No. 200710192804.6 (11 pp.).
Office Action, mailed Mar. 25, 2011, in corresponding U.S. Appl. No. 11/984,315.
Notice of Allowance, mailed Oct. 17, 2011, in corresponding U.S. Appl. No. 11/984,315.
Office Action mailed Apr. 6, 2012 in corresponding U.S. Appl. No. 13/354,749.
Notice of Allowance mailed Nov. 23, 2012 in corresponding U.S. Appl. No. 13/354,749.
Supplemental Notice of Allowability mailed Mar. 11, 2013 in corresponding U.S. Appl. No. 13/354,749.
Office Action mailed Sep. 26, 2013 in corresponding U.S. Appl. No. 13/858,688.
Notice of Allowance mailed Apr. 25, 2014 in corresponding U.S. Appl. No. 13/858,688.
U.S. Appl. No. 11/984,315, filed Nov. 15, 2007, Ki-Hyun Choo, Samsung Electronics Co., Ltd.
U.S. Appl. No. 13/354,749, filed Jan. 20, 2012, Ki-Hyun Choo, Samsung Electronics Co., Ltd.
U.S. Appl. No. 13/858,688, filed Apr. 8, 2013, Ki-Hyun Choo, Samsung Electronics Co., Ltd.
Korean Office Action dated Dec. 18, 2014 from Korean Patent Application No. 10-2014-0102623, 6 pages.
Chinese Office Action dated Dec. 26, 2014 from Chinese Patent Application No. 201210356808.4, 22 pages.
Communication issued Jan. 11, 2016 by the Korean Intellectual Property Office in counterpart Korean Application No. 10-2015-0151097.

* cited by examiner

METHOD AND APPARATUS FOR ENCODING AND DECODING HIGH FREQUENCY SIGNAL

CROSS-REFERENCE TO RELATED PATENT APPLICATION

This application is a continuation of U.S. application Ser. No. 13/858,688, filed on Apr. 8, 2013 in the U.S. Patent and Trademark Office, which is a continuation of U.S. application Ser. No. 13/354,749, filed on Jan. 20, 2012 in the U.S. Patent and Trademark Office, which is a continuation of U.S. Ser. No. 11/984,315, filed on Nov. 15, 2007 in the U.S. Patent and Trademark Office, which claims the priority benefit of Korean Patent Application Nos. 10-2006-0113904, filed on Nov. 17, 2006, and 10-2006-0116045, filed on Nov. 22, 2006 in the Korean Intellectual Property Office, the disclosures of each of which are incorporated herein in their entirety by reference.

BACKGROUND OF THE INVENTION

1. Field of the Invention

The present invention relates to a method and apparatus for encoding and decoding an audio signal, and more particularly, to a method and apparatus for efficiently encoding and decoding both an audio signal and a speech signal by using few bits.

2. Description of the Related Art

Audio signals, such as speech signals or music signals, can be classified into a low frequency signal, which is in a domain smaller than a predetermined frequency, and a high frequency signal, which is in a domain higher than the predetermined frequency, by dividing the audio signals based on the predetermined frequency.

Since the high frequency signal is not relatively important compared to the low frequency signal for recognizing the audio signals due to a hearing characteristic of a human being. Accordingly, spectral band replication (SBR) is developed as a technology for encoding/decoding an audio signal. According to SBR, an encoder encodes a low frequency signal according to a conventional encoding method, and encodes a part of information of a high frequency signal by using the low frequency signal. Also, a decoder decodes the low frequency signal according to a conventional decoding method, and decodes the high frequency signal by using the low frequency signal decoded by applying the part of information encoded in the encoder.

SUMMARY OF THE INVENTION

The present invention provides a method and apparatus for encoding or decoding a high frequency signal by using a low frequency signal.

According to an aspect of the present invention, there is provided a method of encoding a high frequency signal, the method comprising: extracting a coefficient by linear predicting a high frequency signal, and encoding the coefficient; generating a signal by using the extracted coefficient and a low frequency signal; and encoding the high frequency signal by calculating a ratio between an energy value of the high frequency signal and an energy value of the generated signal.

According to another aspect of the present invention, there is provided a method of decoding a high frequency signal, the method comprising: decoding a coefficient, which is extracted by linear predicting a high frequency signal, and a low frequency signal, and generating a signal by using the decoded coefficient and the decoded low frequency signal; and adjusting the generated signal by decoding a ratio between an energy value the generated signal and an energy value of the high frequency signal.

According to another aspect of the present invention, there is provided an apparatus for encoding a high frequency signal, the apparatus comprising: a linear predictor to extract a coefficient by linear predicting a high frequency signal, and to encode the extracted coefficient; a signal generator to generate a signal by using the extracted coefficient and a low frequency signal; and a gain calculator to calculate a ratio between an energy value of the high frequency signal and an energy value of the generated signal, and to encode the ratio.

According to another aspect of the present invention, there is provided an apparatus for decoding a high frequency signal, the apparatus comprising: a signal generator to decode a coefficient, which is extracted by linear predicting a high frequency signal, and a low frequency signal and to generate a signal by using the decoded coefficient and the decoded low frequency signal; and a gain applier to adjust the generated signal by decoding a ratio of an energy value of the generated signal and an energy value of the high frequency signal.

According to another aspect of the present invention, there is provided a method of encoding a high frequency signal, the method including: extracting a coefficient by linear predicting a high frequency signal and encoding the coefficient; generating a first signal by using the extracted coefficient, transforming the first signal to a frequency domain, and then normalizing the transformed first signal; transforming a low frequency signal to the frequency domain and generating a second signal by using the transformed low frequency signal; generating a third signal by calculating the normalized first signal and the generated second signal by using a preset method, and inverse transforming the third signal to a time domain; and encoding the high frequency signal by calculating a ratio between the inverse transformed third signal and an energy value of the high frequency signal.

According to another aspect of the present invention, there is provided a method of encoding a high frequency signal, the method including: extracting a coefficient by linear predicting a high frequency signal and encoding the extracted coefficient; generating a first signal by using the extracted coefficient, transforming the first signal to a frequency domain, and normalizing the transformed first signal; extracting a residual signal by linear predicting a low frequency signal; transforming the extracted residual signal to the frequency domain and generating a second signal by using the transformed residual signal; generating a third signal by calculating the normalized first signal and the generates second signal by using a preset method, and inverse transforming the third signal to a time domain; and encoding the high frequency signal by calculating a ratio between the inverse transformed third signal and an energy value of the high frequency signal.

According to another aspect of the present invention, there is provided a method of decoding a high frequency signal, the method including: decoding a coefficient, which is extracted by linear predicting a high frequency signal, and a low frequency signal; generating a first signal by using the decoded coefficient, transforming the first signal to a frequency domain, and normalizing the transformed first signal; transforming the decoded low frequency signal to the frequency domain and generating a second signal by using the transformed low frequency signal; generating a third signal by calculating the normalized first signal and the generated second signal by using a preset method, and inverse transforming the third signal to a time domain; and adjusting the inverse transformed third signal by decoding a ratio between the generated third signal and an energy value of the high frequency signal.

According to another aspect of the present invention, there is provided a method of decoding a high frequency signal, the method including: decoding a coefficient, which is extracted by linear predicting a high frequency signal, and a low frequency signal; generating a first signal by using the decoded coefficient, transforming the first signal to a frequency domain, and the normalizing the transformed first signal; extracting a residual signal by linear predicting the decoded low frequency signal; transforming the extracted residual signal to the frequency domain and generating a second signal by using the transformed residual signal; generating a third signal by calculating the normalized first signal and the generated second signal by using a preset method and inverse transforming the third signal to a time domain; and adjusting the inverse transformed third signal by decoding a ratio between the generated signal and an energy value of the high frequency signal.

According to another aspect of the present invention, there is provided a method of encoding a high frequency signal, the method including: extracting a coefficient by linear predicting a high frequency signal, and encoding the coefficient; extracting a residual signal by linear predicting a low frequency signal; synthesizing the extracted residual signal and the extracted coefficient; transforming the synthesized residual signal and the high frequency signal to a frequency domain; and encoding the high frequency band by calculating a ratio between the transformed residual signal and an energy value of the transformed high frequency signal.

According to another aspect of the present invention, there is provided a method of decoding a high frequency signal, the method including: decoding a coefficient, which is extracted by linear predicting a high frequency signal, and a low frequency signal; extracting a residual signal by linear predicting the decoded low frequency signal; synthesizing the extracted residual signal and the decoded coefficient; transforming the synthesized residual signal to a frequency domain; adjusting the synthesized residual signal by decoding a ratio between the transformed residual signal and an energy value of the high frequency signal; and inverse transforming the adjusted residual signal to a time domain.

According to another aspect of the present invention, there is provided a computer readable recording medium having recorded thereon a program for executing a method of encoding a high frequency signal, the method comprising: extracting a coefficient by linear predicting a high frequency signal, and encoding the coefficient; generating a signal by using the extracted coefficient and a low frequency signal; and encoding the high frequency signal by calculating a ratio between an energy value of the high frequency signal and an energy value of the generated signal.

According to another aspect of the present invention, there is provided a computer readable recording medium having recorded thereon a program for executing a method of decoding a high frequency signal, the method comprising: decoding a coefficient, which is extracted by linear predicting a high frequency signal, and a low frequency signal, and generating a signal by using the decoded coefficient and the decoded low frequency signal; and adjusting the generated signal by decoding a ratio between an energy value of the generated signal and an energy value of the high frequency signal.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown.

Figure 1:
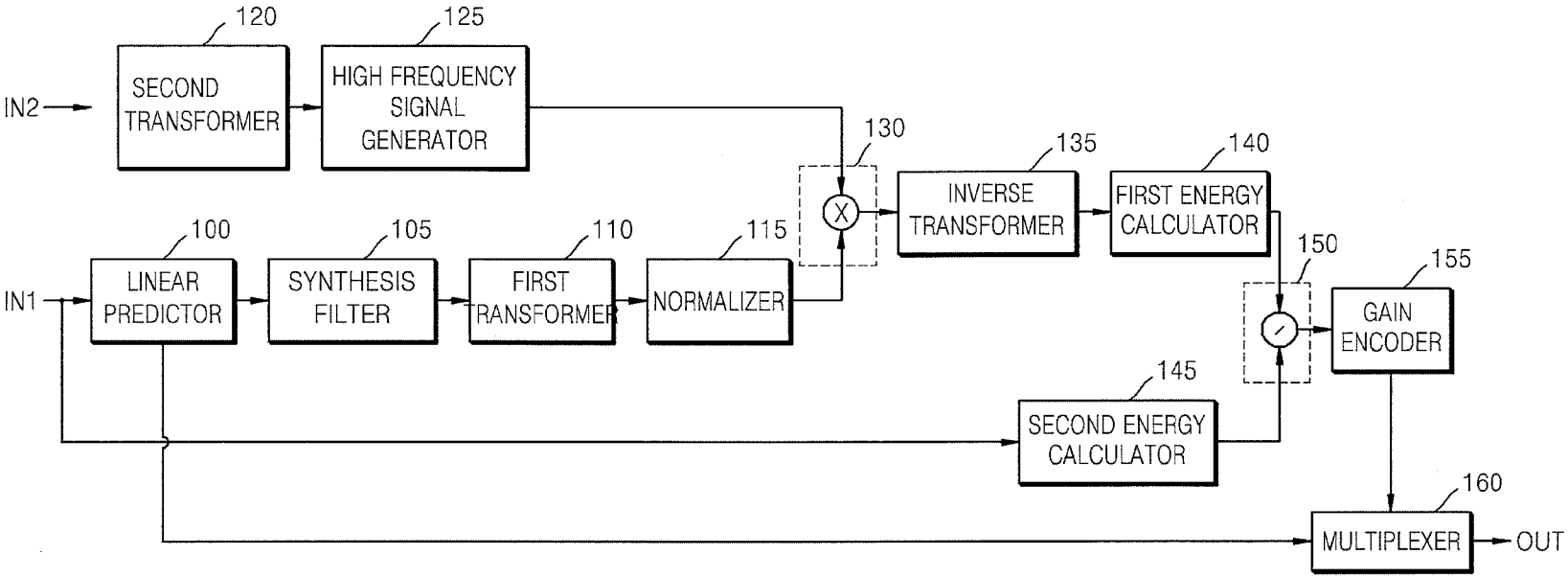
FIG. 1 is a block diagram illustrating an apparatus for encoding a high frequency signal according to an embodiment of the present invention.

FIG. 1 is a block diagram illustrating an apparatus for encoding a high frequency signal according to an embodiment of the present invention. The apparatus includes a linear predictor 100, a synthesis filter 105, a first transformer 110, a normalizer 115, a second transformer 120, a high frequency signal generator 125, a calculator 130, an inverse transformer 135, a first energy calculator 140, a second energy calculator 145, a gain calculator 150, a gain encoder 155, and a multiplexer 160.

The linear predictor 100 extracts a coefficient by linear predicting a high frequency signal, which is prepared in a high frequency band higher than a frequency preset through an input terminal IN1. In detail, the linear predictor 100 may extract a linear predictive coding (LPC) coefficient by performing an LPC analysis on the high frequency signal, and then may perform interpolation on the LPC coefficient.

The synthesis filter 105 generates an impulse response by making the coefficient extracted from the linear predictor 100 as a filter coefficient.

The first transformer 110 transforms the impulse response generated in the synthesis filter 105 from a time domain to a frequency domain. The first transformer 110 may transform the impulse response through a 64-point fast Fourier transform (FFT). Also, the first transformer 110 may transform the impulse response by performing a transform to a frequency domain, such as a modified discrete cosine transform (MDCT) and a modified discrete sine transform (MDST), or a transform of a signal according to a sub band, such as a quadrature mirror filter (QMF) and a frequency varying modulated lapped transform (FV-MLT).

The normalizer 115 normalizes an energy level of a signal transformed in the first transformer 110 so that energy of the signal does not remarkably change. However, in the apparatus according to the current embodiment of the present invention, the normalizer 115 may not be included.

The second transformer 120 receives a low frequency signal, which is prepared in a low frequency domain lower than a frequency preset through an input terminal IN2, and transforms the low frequency signal from the time domain to the frequency domain according to the same transform used by the first transformer 110. Here, the second transformer 120 transforms the low frequency signal to the same points as the first transformer 110 transforms the high frequency signal, and the second transformer 120 may perform the 64-point FFT.

The high frequency signal generator 125 generates a signal by using the low frequency signal transformed in the second transformer 120. The high frequency signal generator 125 can generate the signal by copying the low frequency signal transformed in the second transformer 120 in the high frequency band or by symmetrically folding the low frequency signal in the high frequency band based on the preset frequency.

The calculator 130 generates a signal by calculating the signal normalized in the normalizer 115 and the signal generated in the high frequency signal generator 125 by using a preset method. Here, the preset method may be multiplication as illustrated in FIG. 1, but it is not limited thereto, and the preset method may be an operation performing multiplication, division, or combination of multiplication and division.

The inverse transformer 135 performs an inverse operation of the first and second transformers 110 and 120, and thus inverse transforms the signal generated in the calculator 130 from the frequency domain to the time domain. Here, the inverse transformer 135 performs inverse transform in the same points as the first and second transformers 110 and 120 perform transform. The inverse transformer 135 may perform a 64-point inverse FFT (IFFT).

The first energy calculator 140 calculates an energy value of the signal inverse transformed in the inverse transformer 135 according to each preset unit. An example of the preset unit includes a sub-frame.

The second energy calculator 145 receives a high frequency signal through the input terminal IN1 and then calculates an energy value of the high frequency signal according to each preset unit. An example of the preset unit includes a sub-frame.

The gain calculator 150 calculates a gain according to each preset unit by calculating a ratio between the energy value according to each unit calculated in the first energy calculator 140 and the energy value according to each unit calculated in the second energy calculator 145. The gain calculator 150 can calculate the gain by dividing the energy value according to each unit calculated in the second energy calculator 145 by the energy value according to each unit calculated in the first energy calculator 140 as illustrated in FIG. 1.

The gain encoder 155 encodes the gain according to each unit calculated in the gain calculator 150.

The multiplexer 160 generates a bitstream by multiplexing the coefficient extracted from the linear predictor 100 and the gains encoded in the gain encoder 155, and outputs the bitstream to an output terminal OUT.

Figure 2:
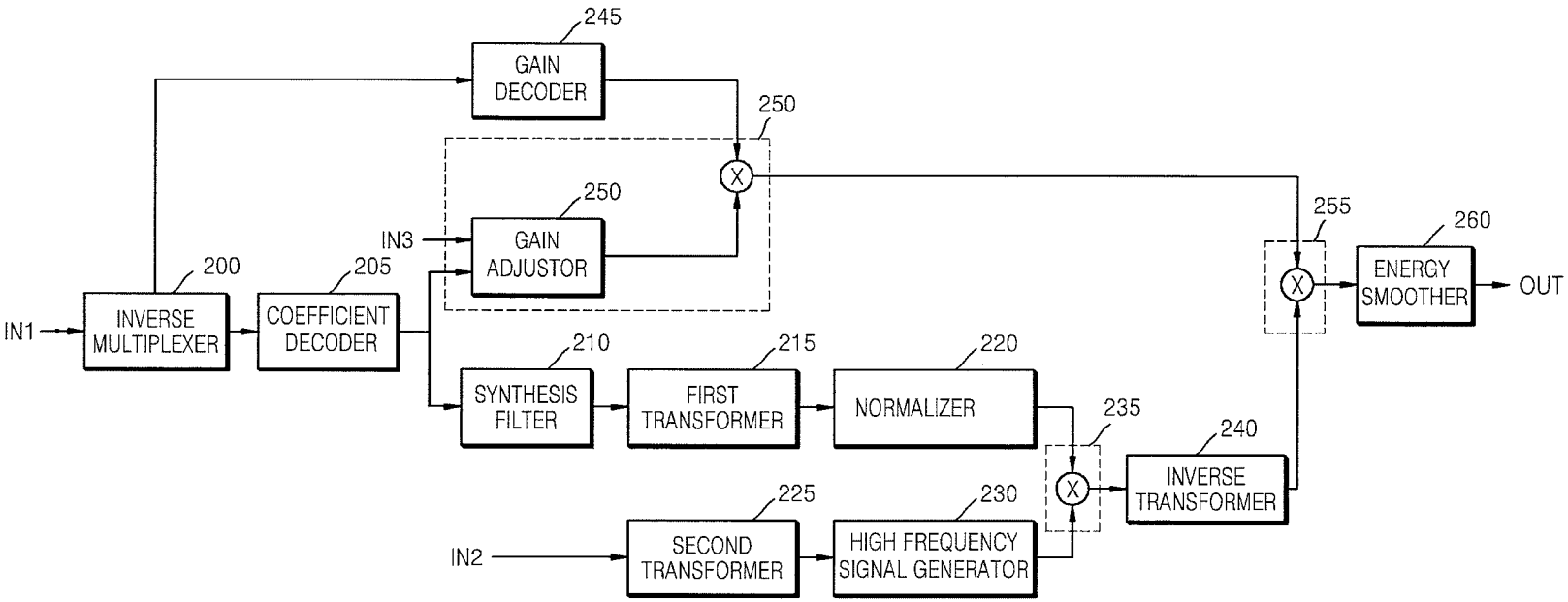
FIG. 2 is a block diagram illustrating an apparatus for decoding a high frequency signal according to an embodiment of the present invention.

FIG. 2 is a block diagram illustrating an apparatus for decoding a high frequency signal according to an embodiment of the present invention. The apparatus according to the current embodiment of the present invention includes an inverse multiplexer 200, a coefficient decoder 205, a synthesis filter 210, a first transformer 215, a normalizer 220, a second transformer 225, a high frequency signal generator 230, a first calculator 235, an inverse transformer 240, a gain decoder 245, a gain adjustor 250, a gain applier 255, and an energy smoother 260.

The inverse multiplexer 200 receives a bitstream through an input terminal IN1 and inverse multiplexes the received bitstream. The inverse multiplexer 200 inverse multiplexes a coefficient, which is extracted by linear predicting a high frequency signal prepared in a domain bigger than a preset frequency, and gains, which are to adjust a signal generated by using a low frequency signal prepared in a smaller domain than the preset frequency.

The coefficient decoder 205 receives the coefficient, which is extracted by linear predicting the high frequency signal during encoding and then encoded, from the inverse multiplexer 200, and decodes the coefficient. In detail, the coefficient decoder 205 may decode an LPC coefficient of the high frequency signal and interpolates the decoded LPC coefficient.

The synthesis filter 210 generates an impulse response by making the coefficient decoded in the coefficient decoder 210 to a filter coefficient.

The first transformer 215 transforms the impulse response generated in the synthesis filter 210 from a time domain to a frequency domain. The first transformer 215 may transform the impulse response through a 64-point FFT. Also, the first transformer 215 may transform the impulse response by performing a transform to a frequency domain, such as an MDCT and an MDST, or a transform of a signal according to a sub band, such as a QMF and an FV-MLT.

The normalizer 220 normalizes an energy level of a signal transformed in the first transformer 215 so that energy of the signal does not remarkably change. However, in the apparatus according to the current embodiment of the present invention, the normalizer 220 may not be included.

The second transformer 225 receives the decoded low frequency signal through an input terminal IN2 and transforms the received low frequency signal from the time domain to the frequency domain by using the same transform as the first transformer 215. Here, the second transformer 225 transforms the low frequency signal to the same points as the first transformer 215, and the second transformer 225 may perform the 64-point FFT.

The high frequency signal generator 230 generates a signal by using the low frequency signal transformed in the second transformer 225. The high frequency signal generator 230 can generate the signal by copying the low frequency signal transformed in the second transformer 225 in the high frequency band or by symmetrically folding the low frequency signal in the high frequency band based on the preset frequency.

The first calculator 235 generates a signal by calculating the signal normalized in the normalizer 220 and the signal generated in the high frequency signal generator 230 by using a preset method. Here, the preset method may be multiplication as illustrated in FIG. 2, but it is not limited thereto, and the preset method may be an operation performing multiplication, division, or combination of multiplication and division.

The inverse transformer 240 performs an inverse operation of the first and second transformers 215 and 225, and thus inverse transforms the signal generated in the first calculator 235 from the frequency domain to the time domain. Here, the inverse transformer 240 performs inverse transform in the same points as the first and second transformers 215 and 225 perform transform. The inverse transformer 240 may perform a 64-point IFFT.

The gain decoder 245 decodes the gains according to each preset unit inverse multiplexed in the inverse multiplexer 200. An example of the preset unit includes a sub-frame.

The gain adjustor 250 adjusts the gain decoded in the gain decoder 245 so that the signal does not remarkably change in the boundary of the low frequency signal and the high frequency signal. The gain adjustor 250 may use a coefficient extracted by linear predicting the low frequency signal received through an input terminal IN3 and a coefficient extracted by linear predicting the high frequency signal decoded by the coefficient decoder 205 while adjusting the gain. For example, the gain adjustor 250 may adjust the gain by calculating a value to be multiplied in order to adjust the gain, and then dividing the gain decoded in the gain decoder 235 by the value to be multiplied. However, the apparatus according to the current embodiment of the present invention may not include the gain adjustor 250.

The gain applier 255 applies the gain adjusted in the gain adjustor 250 to the signal inverse transformed in the inverse transformer 240. For example, the gain applier 255 applies the gain by multiplying the gain according to each unit adjusted in the gain adjustor 250 to the signal inverse transformed in the inverse transformer 240.

The energy smoother 260 restores the high frequency signal by smoothing the energy value according to preset units so that the energy value according to preset units does not remarkably change, and outputs the restored high frequency signal through an output unit OUT. However, the apparatus according to the current embodiment of the present invention may not include the energy smoother 260.

Figure 3:
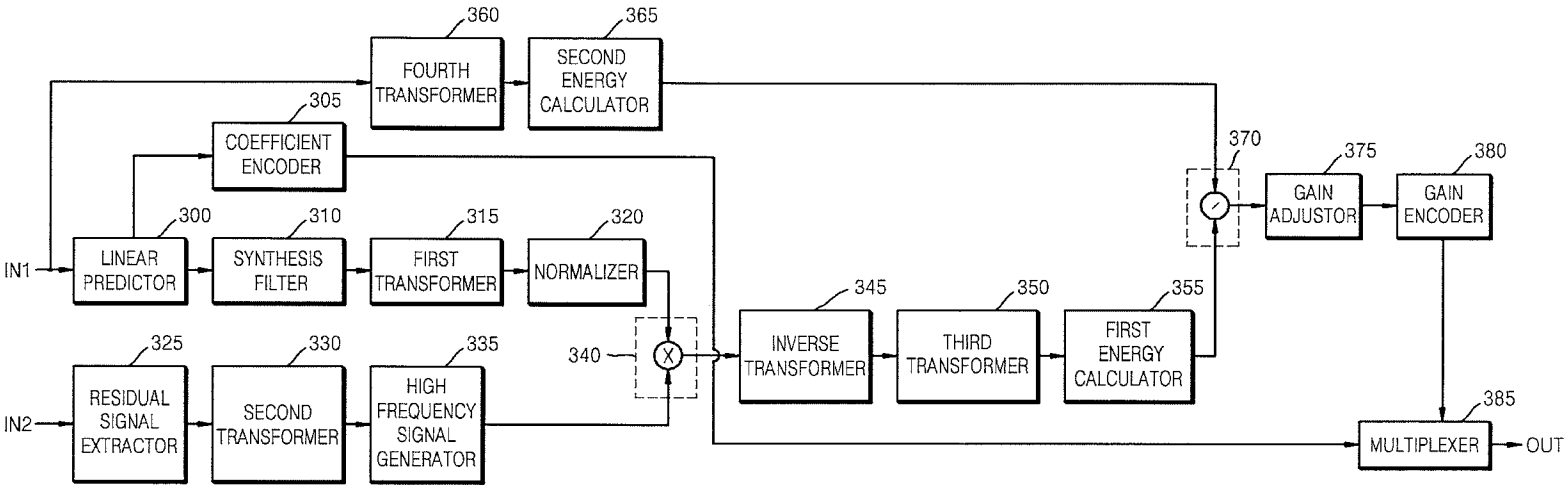
FIG. 3 is a block diagram illustrating an apparatus for encoding a high frequency signal according to another embodiment of the present invention.

FIG. 3 is a block diagram illustrating an apparatus for encoding a high frequency signal according to another embodiment of the present invention. The apparatus according to the current embodiment of the present invention includes a linear predictor 300, a coefficient encoder 305, a synthesis filter 310, a first transformer 315, a normalizer 320, a residual signal extractor 325, a second transformer 330, a high frequency signal generator 335, a calculator 340, an inverse transformer 345, a third transformer 350, a first energy calculator 335, a fourth transformer 360, a second energy calculator 365, a gain calculator 370, a gain adjustor 375, a gain encoder 380, and a multiplexer 385.

The linear predictor 300 extracts a coefficient by linear predicting a high frequency signal, which is prepared in a high frequency band higher than a frequency preset through an input terminal IN1. In detail, the linear predictor 300 may extract a LPC coefficient by performing an LPC analysis on the high frequency signal, and then may perform interpolation on the LPC coefficient.

The coefficient encoder 305 transforms the coefficient extracted by the linear predictor 300 to a preset coefficient and then encodes the transformed coefficient. In detail, the linear predictor 300 may perform vector quantization after transforming an LPC coefficient extracted by the linear predictor 300 to a line spectrum frequency (LSF) coefficient. The coefficient may also be transformed to a line spectral pair (LSP) coefficient, an immittance spectral frequencies (ISF) coefficient, or an immittance spectral pair (ISP) coefficient.

The synthesis filter 310 generates an impulse response by making the coefficient extracted from the linear predictor 300 as a filter coefficient.

The first transformer 315 transforms the impulse response generated in the synthesis filter 310 from a time domain to a frequency domain. The first transformer 315 may transform the impulse response through a 64-point FFT. Also, the first transformer 315 may transform the impulse response by performing a transform to a frequency domain, such as an MDCT and an MDST, or a transform of a signal according to a sub band, such as a QMF and an FV-MLT.

The normalizer 320 normalizes an energy level of a signal transformed in the first transformer 315 so that energy of the signal does not remarkably change. However, in the apparatus according to the current embodiment of the present invention, the normalizer 320 may not be included.

The residual signal extractor 325 receives a low frequency signal prepared in a domain smaller than the preset frequency through an input terminal IN2, and extracts a residual signal by linear predicting the low frequency signal. In detail, the residual signal extractor 325 may extract an LPC coefficient by performing an LPC analysis on the low frequency signal and then extract the residual signal excluding components of the LPC coefficient from the low frequency signal.

The second transformer 330 transforms the residual signal extracted from the residual signal extractor 325 from a time domain to a frequency domain by using the same transform as the first transformer 315. Here, the second transformer 330 transforms the residual signal to the same points as the first transformer 315, and the second transformer 330 may perform the 64-point FFT.

The high frequency signal generator 335 generates a signal in the high frequency band, which is a bigger domain than the preset frequency by using the residual signal transformed in the second transformer 330. The high frequency signal generator 335 can generate the signal by copying the residual signal transformed in the second transformer 330 in the high frequency band or by symmetrically folding the residual signal in the high frequency band based on the preset frequency.

The calculator 340 generates a signal by calculating the signal normalized in the normalizer 320 and the signal generated in the high frequency signal generator 335 by using a preset method. Here, the preset method may be multiplication as illustrated in FIG. 3, but it is not limited thereto, and the preset method may be an operation performing multiplication, division, or combination of multiplication and division.

The inverse transformer 345 inverse transforms the signal generated in the calculator 340 from the frequency domain to the time domain. Here, the inverse transformer 345 performs inverse transform in the same points as the first and second transformers 315 and 330 perform transform. The inverse transformer 345 may perform a 64-point IFFT.

The third transformer 350 transforms the signal inverse transformed by the inverse transformer 345 from the time domain to the frequency domain. The third transformer 350 may transform the signal to points different from the inverse transformer 345, and the third transformer 350 may perform 288-point FFT. Also, the third transformer 350 may transform the signal by performing a transform to a frequency domain, such as an MDCT and an MDST, or a transform of a signal according to a sub band, such as a QMF and an FV-MLT.

The first energy calculator 355 calculates an energy value of the signal transformed in the third transformer 350 according to each preset unit. An example of the preset unit includes a sub-band.

The fourth transformer 360 receives the high frequency signal through the input terminal IN1 and transforms the high frequency signal from the time domain to the frequency domain. Here, the fourth transformer 360 transforms the high frequency signal to the same points as the third transformer 360, and the fourth transformer 360 may perform the 288-point FFT.

The second energy calculator 365 calculates an energy value according to preset units transformed by the fourth transformer 360. An example of the preset unit includes a sub-band.

The gain calculator 370 calculates a gain according to each preset unit by calculating a ratio between the energy value according to each unit calculated in the first energy calculator 355 and the energy value according to each unit calculated in the second energy calculator 365. The gain calculator 370 can calculate the gain by dividing the energy value according to each unit calculated in the second energy calculator 365 by the energy value according to each unit calculated in the first energy calculator 355 as illustrated in FIG. 3.

The gain adjustor 375 adjusts the gain calculated by the gain calculator 370 so that noise is not further generated in a high frequency signal generated in a decoding terminal when characteristics of a low frequency signal and the high frequency signal are different. For example, the gain adjustor 375 can adjust each calculated ratio by using a ratio of tonality of the low frequency signal to tonality of the high frequency signal. However, the apparatus according to the current embodiment of the present invention may not include the gain adjustor 375.

The gain encoder 380 encodes the gain according to each unit calculated in the gain calculator 375.

The multiplexer 385 generates a bitstream by multiplexing the coefficient encoded by the coefficient encoder 305 and the gains encoded in the gain encoder 380, and outputs the bitstream to an output terminal OUT.

Figure 4:
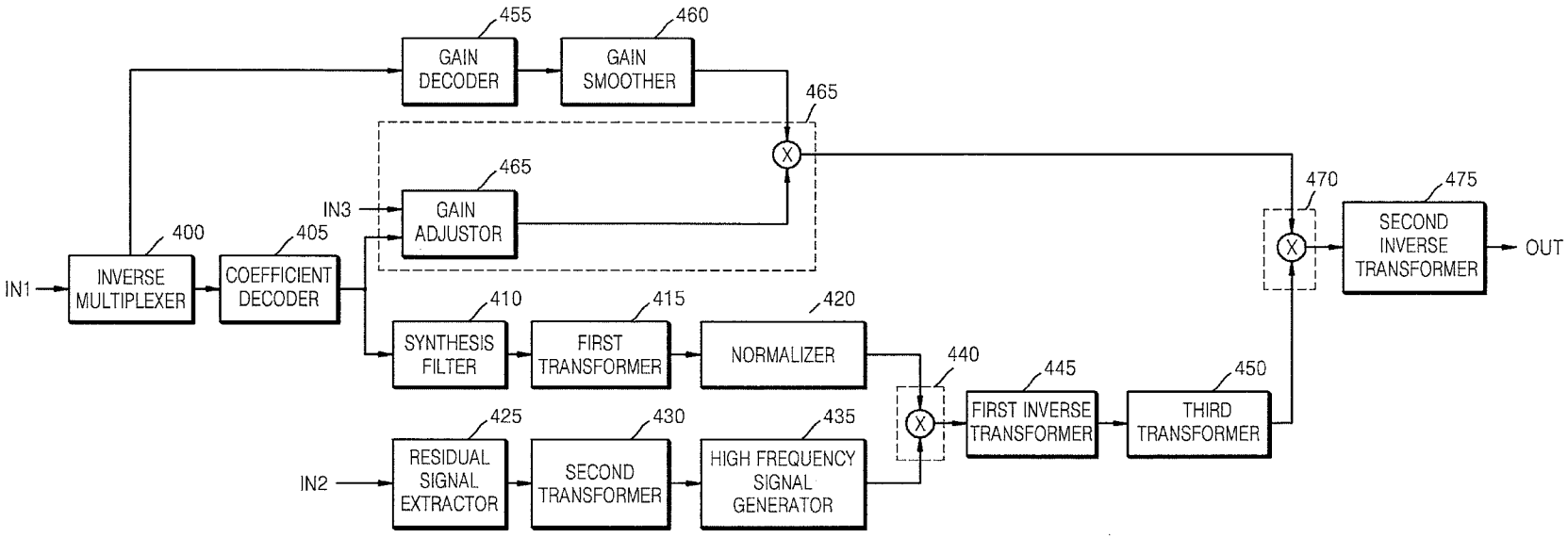
FIG. 4 is a block diagram illustrating an apparatus for decoding a high frequency signal according to another embodiment of the present invention.

FIG. 4 is a block diagram illustrating an apparatus for decoding a high frequency signal according to another embodiment of the present invention. The apparatus according to the current embodiment of the present invention includes an inverse multiplexer 400, a coefficient decoder 405, a synthesis filter 410, a first transformer 415, a normalizer 420, a residual signal extractor 425, a second transformer 430, a high frequency signal generator 435, a calculator 440, a first inverse transformer 445, a third transformer 450, a gain decoder 455, a gain smoother 460, a gain adjustor 465, a gain applier 470, and a second inverse transformer 475.

The inverse multiplexer 400 receives a bitstream through an input terminal IN1 and inverse multiplexes the received bitstream. The inverse multiplexer 400 inverse multiplexes a coefficient, which is extracted by linear predicting a high frequency signal prepared in a domain bigger than a preset frequency, and gains, which are to adjust a signal generated by using a low frequency signal prepared in a smaller domain than the preset frequency.

The coefficient decoder 405 receives the coefficient, which is extracted by linear predicting the high frequency signal during encoding and then encoded, from the inverse multiplexer 400, and decodes the coefficient. In detail, the coefficient decoder 405 may decode an LPC coefficient of the high frequency signal and interpolates the decoded LPC coefficient.

The synthesis filter 410 generates an impulse response by making the coefficient decoded in the coefficient decoder 405 to a filter coefficient.

The first transformer 415 transforms the impulse response generated in the synthesis filter 410 from a time domain to a frequency domain. The first transformer 415 may transform the impulse response through a 64-point FFT. Also, the first transformer 415 may transform the impulse response by performing a transform to a frequency domain, such as an MDCT and an MDST, or a transform of a signal according to a sub band, such as a QMF and an FV-MLT.

The normalizer 420 normalizes an energy level of a signal transformed in the first transformer 415 so that energy of the signal does not remarkably change. However, in the apparatus according to the current embodiment of the present invention, the normalizer 420 may not be included.

The residual signal extractor 425 receives a decoded low frequency signal through an input terminal IN2, and extracts a residual signal by linear predicting the low frequency signal. In detail, the residual signal extractor 425 may extract an LPC coefficient by performing an LPC analysis on the decoded low frequency signal and then extract the residual signal excluding components of the LPC coefficient from the low frequency signal.

The second transformer 430 transforms the residual signal extracted from the residual signal extractor 425 from a time domain to a frequency domain by using the same transform as the first transformer 415. Here, the second transformer 430 transforms the residual signal to the same points as the first transformer 415, and the second transformer 430 may perform the 64-point FFT.

The high frequency signal generator 435 generates a signal in the high frequency band, which is a bigger domain than the preset frequency by using the residual signal transformed in the second transformer 430. The high frequency signal generator 435 can generate the signal by copying the residual signal transformed in the second transformer 430 in the high frequency band or by symmetrically folding the residual signal in the high frequency band based on the preset frequency.

The calculator 440 generates a signal by calculating the signal normalized in the normalizer 420 and the signal generated in the high frequency signal generator 435 by using a preset method. Here, the preset method may be multiplication as illustrated in FIG. 4, but it is not limited thereto, and the preset method may be an operation performing multiplication, division, or combination of multiplication and division.

The first inverse transformer 445 performs an inverse operation of the first and second transformers 415 and 430, and thus inverse transforms the signal generated in the calculator 440 from the frequency domain to the time domain. Here, the first inverse transformer 445 performs inverse transform in the same points as the first and second transformers 415 and 430 perform transform. The first inverse transformer 445 may perform a 64-point IFFT.

The third transformer 450 transforms the signal inverse transformed by the first inverse transformer 445 from the time domain to the frequency domain. The third transformer 450 may transform the signal to points different from the first transformer 415, the second transformer 430, and the first inverse transformer 445, and the third transformer 450 may perform 288-point FFT. Also, the third transformer 450 may transform the signal by performing a transform to a frequency domain, such as an MDCT and an MDST, or a transform of a signal according to a sub band, such as a QMF and an FV-MLT.

The gain decoder 455 decodes the gains according to each preset unit inverse multiplexed in the inverse multiplexer 400. An example of the preset unit includes a sub-band.

The gain smoother 460 smoothes each gain so that the energy value according to preset units does not remarkably change. However, the apparatus according to the current embodiment of the present invention may not include the gain smoother 460.

The gain adjustor 465 adjusts the gain smoothed in the gain smoother 460 so that the signal does not remarkably change in the boundary of the low frequency signal and the high frequency signal. The gain adjustor 465 may use a coefficient extracted by linear predicting the low frequency signal received through an input terminal IN3 and a coefficient extracted by linear predicting the high frequency signal decoded by the coefficient decoder 405 while adjusting the gain. For example, the gain adjustor 465 may adjust the gain by calculating a value to be multiplied in order to adjust the gain, and then dividing the gain smoothed in the gain smoother 460 by the value to be multiplied. However, the apparatus according to the current embodiment of the present invention may not include the gain adjustor 465.

The gain applier 470 applies the gain adjusted in the gain adjustor 465 to the signal transformed in the third transformer 450. For example, the gain applier 470 applies the gain by multiplying the gain according to each unit adjusted in the gain adjustor 465 to the signal transformed in the third transformer 450.

The second inverse transformer 475 performs an inverse process of the transform performed by the third transformer 450. The second inverse transformer 475 restores the high frequency signal by transforming the signal, in which the gain is applied, from the frequency domain to the time domain and performing an overlap/add, and outputs the restored high frequency signal to an output terminal OUT. Here, the second inverse transformer 475 transforms the high frequency signal to the same points as the third transformer 450, and the second inverse transformer 475 may perform the 288-point IFFT.

Figure 5:
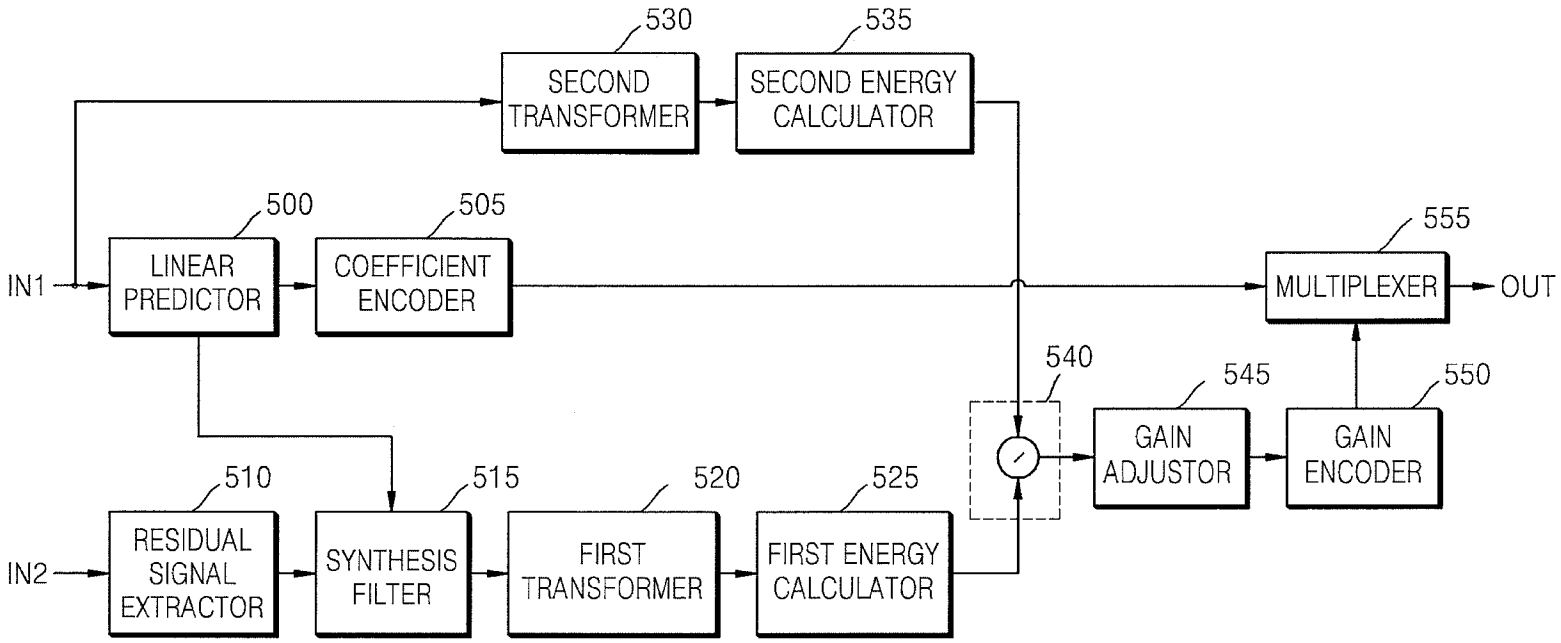
FIG. 5 is a block diagram illustrating an apparatus for encoding a high frequency signal according to another embodiment of the present invention.

FIG. 5 is a block diagram illustrating an apparatus for encoding a high frequency signal according to another embodiment of the present invention. The apparatus according to the current embodiment of the present invention includes a linear predictor 500, a coefficient encoder 505, a residual signal extractor 510, a synthesis filter 515, a first transformer 520, a first energy calculator 525, a second transformer 530, a second energy calculator 535, a gain calculator 540, a gain adjustor 545, a gain encoder 550, and a multiplexer 555.

The linear predictor 500 extracts a coefficient by linear predicting a high frequency signal, which is prepared in a high frequency band higher than a frequency preset through an input terminal IN1. In detail, the linear predictor 500 may extract a LPC coefficient by performing an LPC analysis on the high frequency signal, and then may perform interpolation on the LPC coefficient.

The coefficient encoder 505 transforms the coefficient extracted by the linear predictor 500 to a preset coefficient and then encodes the transformed coefficient. In detail, the linear predictor 500 may perform vector quantization after transforming an LPC coefficient extracted by the linear predictor 500 to an LSF coefficient. The coefficient may also be transformed to an LSP coefficient, an ISF coefficient, or an ISP coefficient.

The residual signal extractor 510 receives a low frequency signal prepared in a domain smaller than the preset frequency through an input terminal IN2, and extracts a residual signal by linear predicting the low frequency signal. In detail, the residual signal extractor 510 may extract an LPC coefficient by performing an LPC analysis on the low frequency signal and then extract the residual signal excluding components of the LPC coefficient from the low frequency signal.

The synthesis filter 515 synthesis the residual signal extracted by the residual signal extractor 510 by making the coefficient extracted from the linear predictor 500 as a filter coefficient.

The first transformer 520 transforms the residual signal synthesized by the synthesis filter 515 from a time domain to a frequency domain. The first transformer 520 may transform the residual signal through a 288-point FFT. Also, the first transformer 520 may transform the impulse response by performing a transform to a frequency domain, such as an MDCT and an MDST, or a transform of a signal according to a sub band, such as a QMF and an FV-MLT.

The first energy calculator 525 calculates an energy value of the signal transformed in the first transformer 520 according to each preset unit. An example of the preset unit includes a sub-band.

The second transformer 530 receives the high frequency signal through the input terminal IN1 and transforms the high frequency signal from the time domain to the frequency domain by using the same transform as the first transformer 520. Here, the second transformer 530 transforms the high frequency signal to the same points as the first transformer 520, and the second transformer 530 may perform the 288-point FFT.

The second energy calculator 535 calculates an energy value according to preset units of the high frequency signal transformed by the second transformer 530. An example of the preset unit includes a sub-band.

The gain calculator 540 calculates a gain according to each preset unit by calculating a ratio between the energy value according to each unit calculated in the first energy calculator 525 and the energy value according to each unit calculated in the second energy calculator 535. The gain calculator 540 can calculate the gain by dividing the energy value according to each unit calculated in the second energy calculator 535 by the energy value according to each unit calculated in the first energy calculator 525 as illustrated in FIG. 5.

The gain adjustor 545 adjusts the gain calculated by the gain calculator 540 so that noise is not further generated in a high frequency signal generated in a decoding terminal when characteristics of a low frequency signal and the high frequency signal are different. For example, the gain adjustor 545 can adjust each calculated ratio by using a ratio of tonality of the low frequency signal to tonality of the high frequency signal. However, the apparatus according to the current embodiment of the present invention may not include the gain adjustor 545.

The gain encoder 550 encodes the gain according to each unit calculated in the gain calculator 545.

The multiplexer 555 generates a bitstream by multiplexing the coefficient encoded by the coefficient encoder 505 and the gains encoded in the gain encoder 550, and outputs the bitstream to an output terminal OUT.

Figure 6:
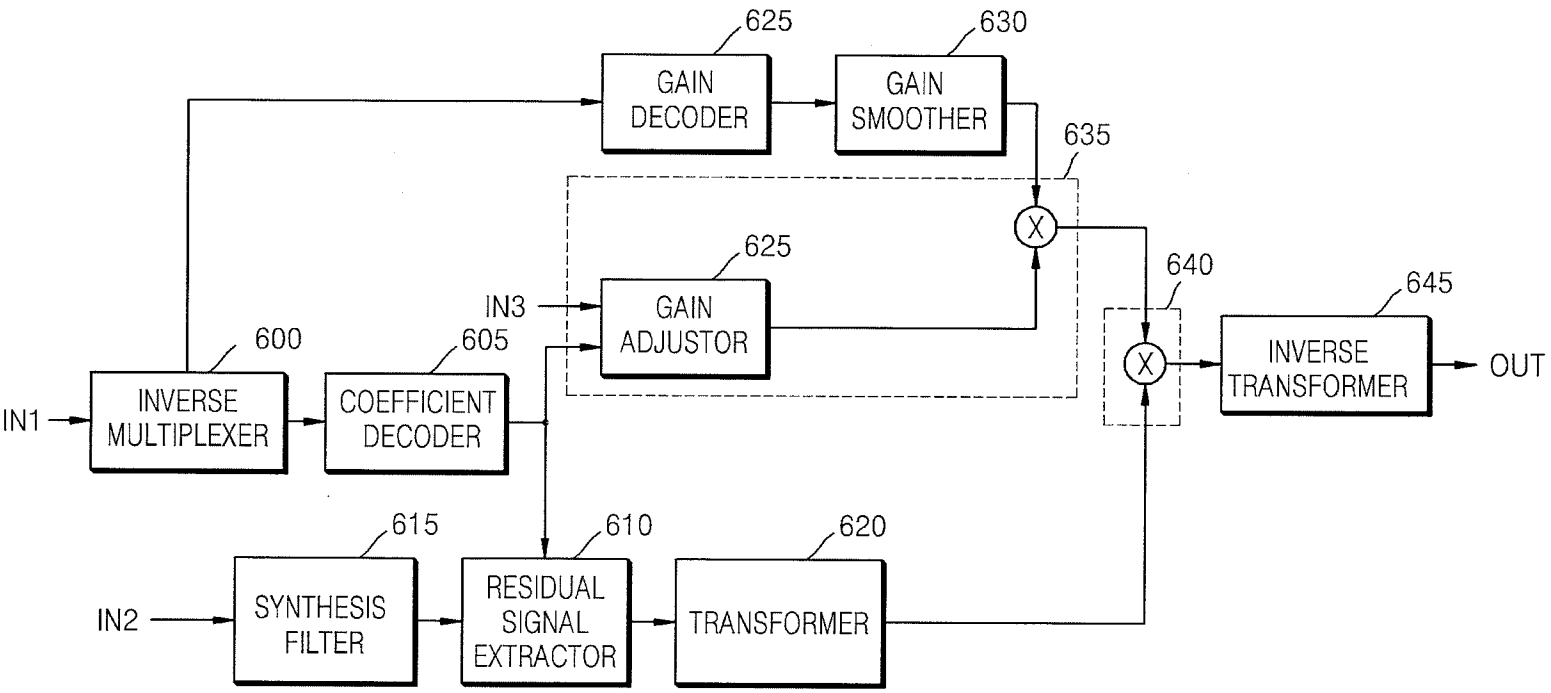
FIG. 6 is a block diagram illustrating an apparatus for decoding a high frequency signal according to another embodiment of the present invention.

FIG. 6 is a block diagram illustrating an apparatus for decoding a high frequency signal according to another embodiment of the present invention. The apparatus according to the current embodiment of the present invention includes an inverse multiplexer 600, a coefficient decoder 605, a residual signal extractor 610, a synthesis filter 615, a transformer 620, a gain decoder 625, a gain smoother 630, a gain adjustor 635, a gain applier 640, and an inverse transformer 645.

The inverse multiplexer 600 receives a bitstream through an input terminal IN1 and inverse multiplexes the received bitstream. The inverse multiplexer 600 inverse multiplexes a coefficient, which is extracted by linear predicting a high frequency signal prepared in a domain bigger than a preset frequency, and gains, which are to adjust a signal generated by using a low frequency signal prepared in a smaller domain than the preset frequency.

The coefficient decoder 605 receives the coefficient, which is extracted by linear predicting the high frequency signal during encoding and then encoded, from the inverse multiplexer 600, and decodes the coefficient. In detail, the coefficient decoder 605 may decode an LPC coefficient of the high frequency signal and interpolates the decoded LPC coefficient.

The residual signal extractor 610 receives a decoded low frequency signal through an input terminal IN2, and extracts a residual signal by linear predicting the low frequency signal. In detail, the residual signal extractor 610 may extract an LPC coefficient by performing an LPC analysis on the decoded low frequency signal and then extract the residual signal excluding components of the LPC coefficient from the low frequency signal.

The synthesis filter 615 synthesis the residual signal extracted by the residual signal extractor 610 by making the coefficient decoded by the coefficient decoder 605 as a filter coefficient.

The transformer 620 transforms the residual signal synthesized by the synthesis filter 615 from a time domain to a frequency domain. The transformer 620 may transform the residual signal through a 288-point FFT.

The gain decoder 625 decodes the gains according to each preset unit inverse multiplexed in the inverse multiplexer 600. An example of the preset unit includes a sub-band.

The gain smoother 630 smoothes each gain decoded by the gain decoder 625 so that the energy between preset units does not remarkably change. However, the apparatus according to the current embodiment of the present invention may not include the gain smoother 630.

The gain adjustor 635 adjusts the gain smoothed in the gain smoother 630 so that the signal does not remarkably change in the boundary of the low frequency signal and the high frequency signal. The gain adjustor 634 may use a coefficient extracted by linear predicting the low frequency signal received through an input terminal IN3 and a coefficient extracted by linear predicting the high frequency signal decoded by the coefficient decoder 605 while adjusting the gain. For example, the gain adjustor 634 may adjust the gain by calculating a value to be multiplied in order to adjust the gain, and then dividing the gain smoothed in the gain smoother 640 by the value to be multiplied. However, the apparatus according to the current embodiment of the present invention may not include the gain adjustor 635.

The gain applier 640 applies the gain adjusted in the gain adjustor 635 to the signal transformed in the transformer 620. For example, the gain applier 640 applies the gain by multiplying the gain according to each unit adjusted in the gain adjustor 635 to the signal transformed in the transformer 620.

The inverse transformer 645 performs an inverse process of the transform performed by the transformer 620. The inverse transformer 640 restores the high frequency signal by transforming the signal, in which the gain is applied, from the frequency domain to the time domain and performing an overlap/add, and outputs the restored high frequency signal to an output terminal OUT. Here, the inverse transformer 645 transforms the high frequency signal to the same points as the transformer 620, and the inverse transformer 645 may perform the 288-point IFFT.

Figure 7:
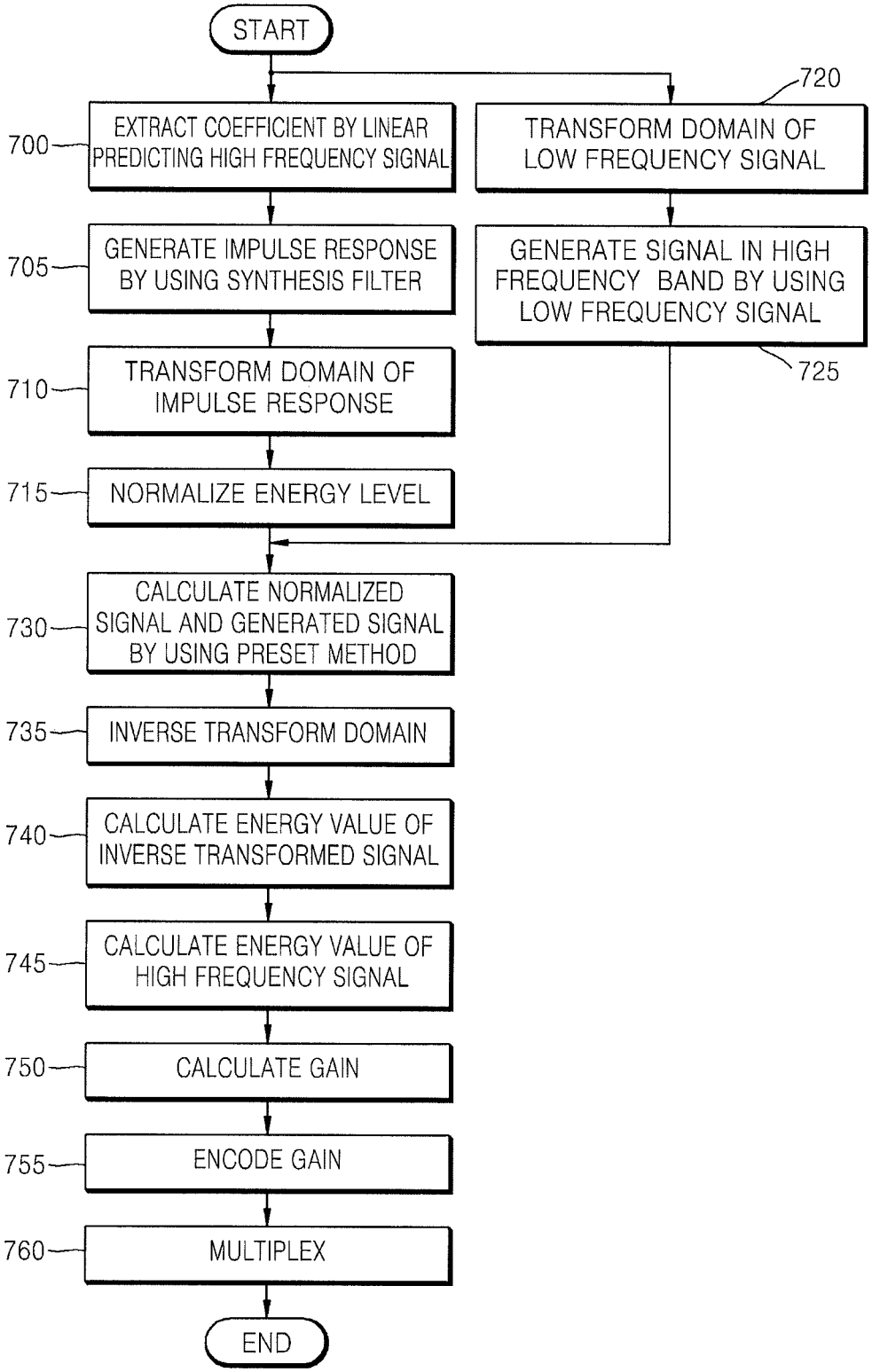
FIG. 7 is a flowchart illustrating a method of encoding a high frequency signal according to an embodiment of the present invention.

FIG. 7 is a flowchart illustrating a method of encoding a high frequency signal according to an embodiment of the present invention.

First, a coefficient is extracted by linear predicting a high frequency signal, which is prepared in a high frequency band higher than a preset frequency in operation 700. In detail, in operation 700, an LPC coefficient may be extracted by performing an LPC analysis on the high frequency signal, and then interpolation may be performed on the LPC coefficient.

In operation 705, a synthesis filter generates an impulse response by making the coefficient extracted in operation 700 as a filter coefficient.

In operation 710, the impulse response generated in operation 705 is transformed from a time domain to a frequency domain. In operation 710, the impulse response may be transformed through a 64-point FFT. Also, the impulse response may be transformed through a transform to a frequency domain, such as an MDCT and an MDST, or a transform of a signal according to a sub band, such as a QMF and a FV-MLT.

In operation 715, an energy level of a signal transformed in operation 710 is normalized so that energy of the signal does not remarkably change. However, the method according to the current embodiment of the present invention may not include operation 715.

In operation 720, a low frequency signal, which is prepared in a low frequency domain lower than the preset frequency, is received and the low frequency signal is transformed from the time domain to the frequency domain according to the same transform used in operation 710. Here, the low frequency signal is transformed to the same points as the high frequency signal is transformed in operation 710 and the 64-point FFT may be performed in operation 720.

In operation 725, a signal is generated in a high frequency band, which is a domain bigger than the preset frequency by using the low frequency signal transformed in operation 720. The signal can be generated by copying the low frequency signal transformed in operation 720 in the high frequency band or by symmetrically folding the low frequency signal in the high frequency band based on the preset frequency.

In operation 730, a signal is generated by calculating the signal normalized in operation 715 and the signal generated in operation 725 by using a preset method. Here, the preset method may be multiplication, but it is not limited thereto, and the preset method may be an operation performing multiplication, division, or combination of multiplication and division.

Operation 735 is an inverse operation of operations 710 and 720. In operation 735, the signal generated in operation 730 is inverse transformed from the frequency domain to the time domain. Here, operation 735 performs inverse transform in the same points as operations 710 and 720 perform transform. Operation 735 may perform a 64-point IFFT.

In operation 740, an energy value of the signal inverse transformed in operation 735 is calculated according to each preset unit. An example of the preset unit includes a sub-frame.

In operation 745, an energy value of the high frequency signal is calculated according to each preset unit. An example of the preset unit includes a sub-frame.

In operation 750, a gain according to each preset unit is calculated by calculating a ratio between the energy value according to each unit calculated in operation 740 and the energy value according to each unit calculated in operation 745. The gain can be calculated by dividing the energy value according to each unit calculated in operation 745 by the energy value according to each unit calculated in operation 740.

In operation 755, the gain is encoded according to each unit calculated in operation 750.

In operation 760, a bitstream is generated by multiplexing the coefficient extracted in operation 700 and the gains encoded in operation 755.

Figure 8:
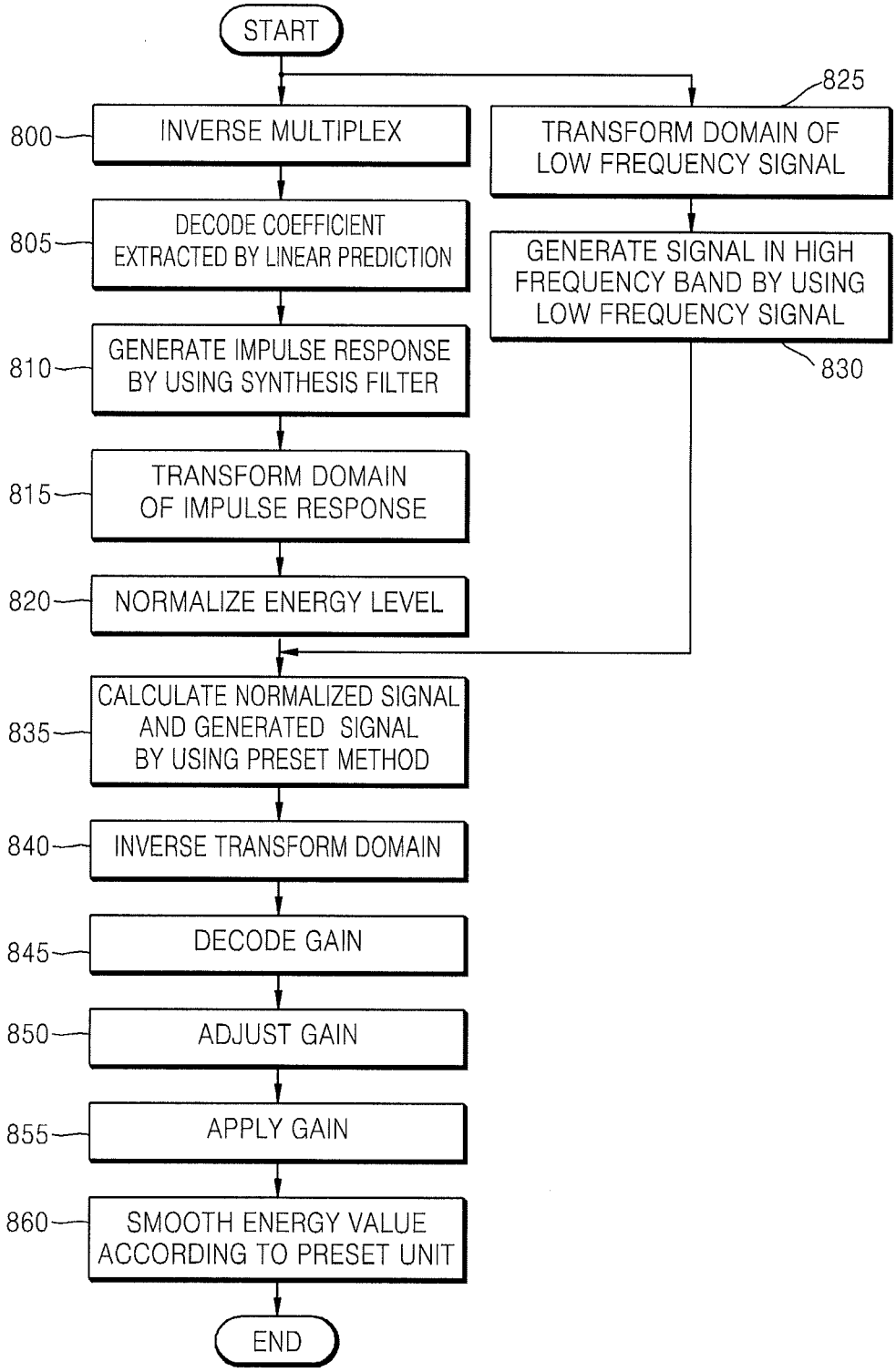
FIG. 8 is a flowchart illustrating a method of decoding a high frequency signal according to an embodiment of the present invention.

FIG. 8 is a flowchart illustrating a method of decoding a high frequency signal according to an embodiment of the present invention.

First, a bitstream is received from an encoding terminal and is inverse multiplexed in operation 800. In operation 800, a coefficient, which is extracted by linear predicting a high frequency signal prepared in a domain bigger than a preset frequency, and gains, which are to adjust a signal generated by using a low frequency signal prepared in a smaller domain than the preset frequency, are inverse multiplexed.

In operation 805, the coefficient, which is extracted by linear predicting the high frequency signal during encoding and then encoded, is decoded. In detail, in operation 805, an LPC coefficient of the high frequency signal may be decoded and the decoded LPC coefficient may be interpolated.

In operation 810, a synthesis filter generates an impulse response by making the coefficient decoded in operation 805 to a filter coefficient.

In operation 815, the impulse response generated in operation 810 is transformed from a time domain to a frequency domain. In operation 815, the impulse response may be transformed through a 64-point FFT. Also the impulse response may be transformed through a transform to a frequency domain, such as an MDCT and an MDST, or a transform of a signal according to a sub band, such as a QMF and an FV-MLT.

In operation 820, an energy level of a signal transformed in operation 815 is normalized so that energy of the signal does not remarkably change. However, the method according to the current embodiment of the present invention may not include operation 820.

In operation 825, the decoded low frequency signal is received and the received low frequency signal is transformed from the time domain to the frequency domain by using the same transform as operation 815. Here, in operation 825, the low frequency signal is transformed to the same points as operation 815, and the 64-point FFT may be performed.

In operation 830, a signal is generated in a high frequency band, which is the bigger domain than the preset frequency by using the low frequency signal transformed in operation 825. The signal can be generated by copying the low frequency signal transformed in operation 825 in the high frequency band or by symmetrically folding the low frequency signal in the high frequency band based on the preset frequency.

In operation 835, a signal is generated by calculating the signal normalized in operation 820 and the signal generated in operation 830 by using a preset method. Here, the preset method may be multiplication, but it is not limited thereto, and the preset method may be an operation performing multiplication, division, or combination of multiplication and division.

Operation 840 is an inverse operation of operations 815 and 825, and thus the signal generated in operation 835 is inverse transformed from the frequency domain to the time domain. Here, in operation 840, the signal is inverse transformed in the same points as operations 815 and 825. The signal may be inverse transformed through a 64-point IFFT.

In operation 845, the gains are decoded according to each preset unit inverse multiplexed in operation 800. An example of the preset unit includes a sub-frame.

In operation 850, the gain decoded in operation 845 is adjusted so that the signal does not remarkably change in the boundary of the low frequency signal and the high frequency signal. A coefficient extracted by linear predicting the low frequency signal and a coefficient extracted by linear predicting the high frequency signal decoded in operation 805 may be used while adjusting the gain. For example, in operation 850, the gain may be adjusted by calculating a value to be multiplied in order to adjust the gain, and then dividing the gain decoded in operation 845 by the value to be multiplied. However, the method according to the current embodiment of the present invention may not include operation 850.

In operation 855, the gain adjusted in operation 850 is applied to the signal inverse transformed in operation 840. For example, the gain is applied by multiplying the gain according to each unit adjusted in operation 850 to the signal inverse transformed in operation 840.

In operation 860, the high frequency signal is restored by smoothing the energy value according to preset units so that the energy value according to preset units does not remarkably change, However, the method according to the current embodiment of the present invention may not include operation 860.

Figure 9:
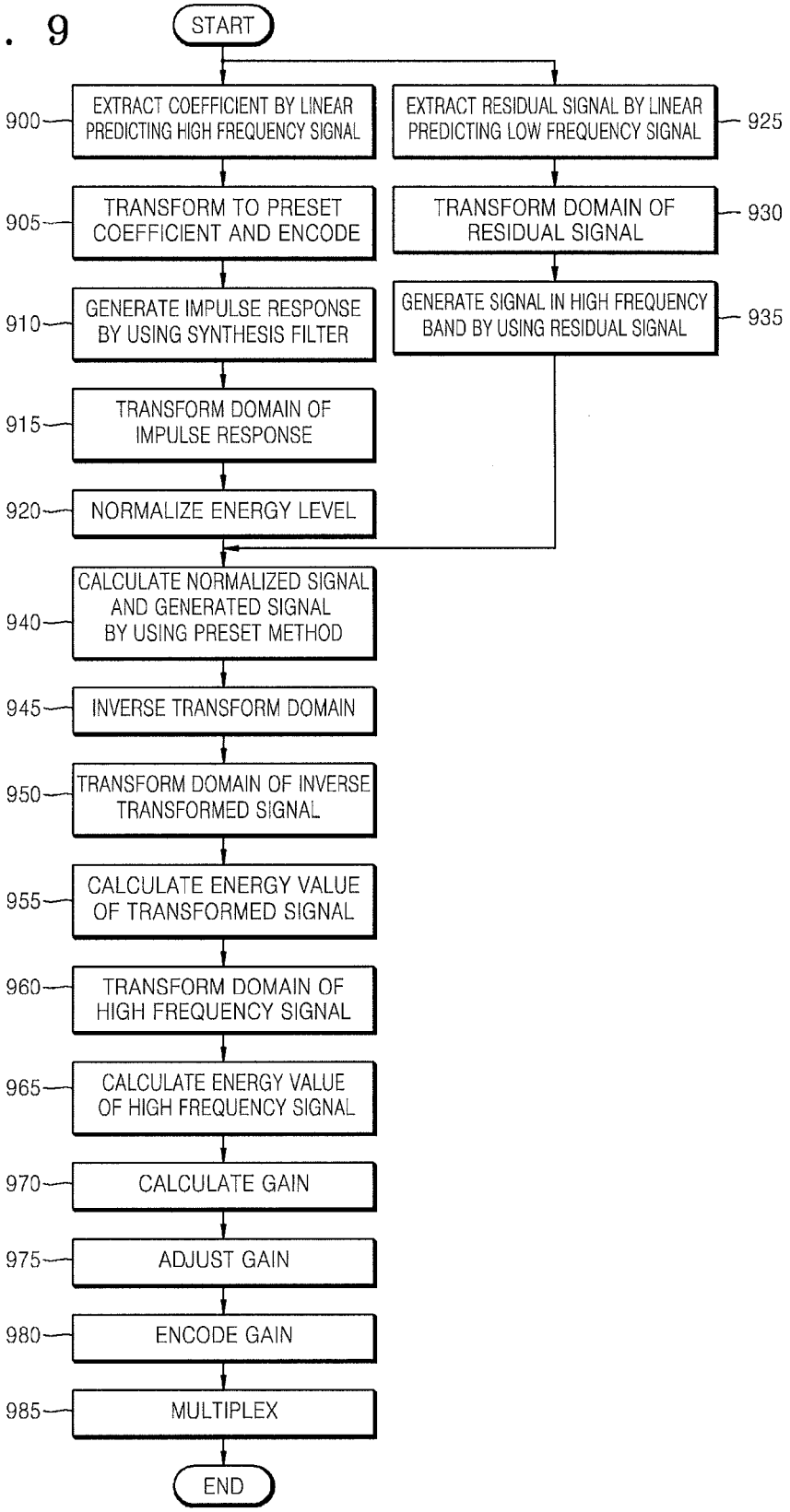
FIG. 9 is a flowchart illustrating a method of encoding a high frequency signal according to another embodiment of the present invention.

FIG. 9 is a flowchart illustrating a method of encoding a high frequency signal according to another embodiment of the present invention.

First, a coefficient is extracted by linear predicting a high frequency signal, which is prepared in a high frequency band higher than a preset frequency in operation 900. In detail, a LPC coefficient may be extracted by performing an LPC analysis on the high frequency signal, and then interpolation may be performed on the LPC coefficient.

In operation 905, the coefficient extracted in operation 900 is transformed to a preset coefficient and then the transformed coefficient is encoded. In detail, vector quantization may be performed after transforming an LPC coefficient extracted in operation 900 to an LSF coefficient. The coefficient may also be transformed to an LSP coefficient, an ISF coefficient, or an ISP coefficient.

In operation 910, a synthesis filter generates an impulse response by making the coefficient extracted in operation 900 as a filter coefficient.

In operation 915, the impulse response generated in operation 910 is transformed from a time domain to a frequency domain. The impulse response may be transformed through a 64-point FFT. Also, the impulse response may be transformed through a transform to a frequency domain, such as an MDCT and an MDST, or a transform of a signal according to a sub band, such as a QMF and an FV-MLT.

In operation 920, an energy level of a signal transformed in operation 915 is normalized so that energy of the signal does not remarkably change. However, the method according to the current embodiment of the present invention may not include operation 920.

In operation 925, a low frequency signal prepared in a domain smaller than the preset frequency is received and a residual signal is extracted by linear predicting the low frequency signal. In detail, an LPC coefficient may be extracted by performing an LPC analysis on the low frequency signal and then the residual signal excluding components of the LPC coefficient may be extracted from the low frequency signal.

In operation 930, the residual signal extracted in operation 925 is transformed from a time domain to a frequency domain by using the same transform as operation 915. Here, the residual signal is transformed to the same points as operation 915, and the 64-point FFT may be performed.

In operation 935, a signal in the high frequency band, which is a bigger domain than the preset frequency, is generated by using the residual signal transformed in operation 930. The signal may be generated by copying the residual signal transformed in operation 930 in the high frequency band or by symmetrically folding the residual signal in the high frequency band based on the preset frequency.

In operation 940, a signal is generated by calculating the signal normalized in operation 920 and the signal generated in operation 935 by using a preset method. Here, the preset method may be multiplication, but it is not limited thereto, and the preset method may be an operation performing multiplication, division, or combination of multiplication and division.

In operation 945, the signal generated in operation 940 is inverse transformed from the frequency domain to the time domain. Here, in operation 945, inverse transform is performed in the same points as operations 915 and 930. Operation 945 may perform a 64-point IFFT.

In operation 950, the signal inverse transformed in operation 945 is transformed from the time domain to the frequency domain. In operation 950, the signal may be transformed to points different from operation 945, and operation 950 may perform 288-point FFT. Also, operation 950 may transform the signal by performing a transform to a frequency domain, such as an MDCT and an MDST, or a transform of a signal according to a sub band, such as a QMF and an FV-MLT.

In operation 955, an energy value of the signal transformed in operation 950 is calculated according to each preset unit. An example of the preset unit includes a sub-frame.

In operation 960, the high frequency signal is received and the high frequency signal is transformed from the time domain to the frequency domain. Here, the high frequency signal is transformed to the same points as operation 950, the 288-point FFT may be performed.

In operation 965, an energy value is calculated according to preset units transformed in operation 960. An example of the preset unit includes a sub-frame.

In operation 970, a gain is calculated according to each preset unit by calculating a ratio between the energy value according to each unit calculated in operation 955 and the energy value according to each unit calculated in operation 965. The gain can be calculated by dividing the energy value according to each unit calculated in operation 965 by the energy value according to each unit calculated in operation 955.

In operation 975, the gain calculated in operation 970 is adjusted so that the energy value according to each preset unit does not remarkably change. However, the method according to the current embodiment of the present invention may not include operation 975.

In operation 980, the gain is encoded according to each unit calculated in operation 975.

In operation 985, a bitstream is generated by multiplexing the coefficient encoded in operation 905 and the gains encoded in operation 980.

Figure 10:
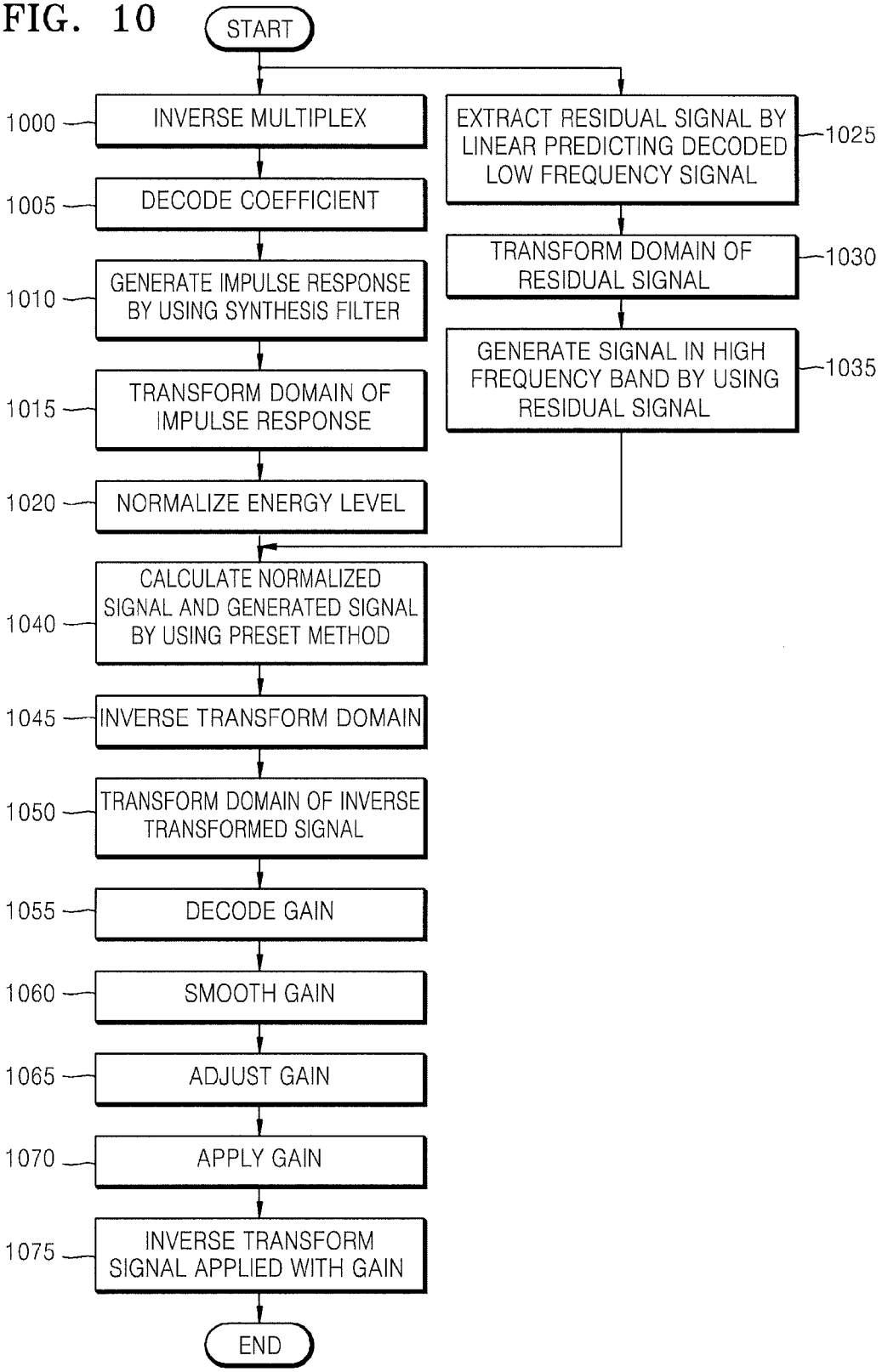
FIG. 10 is a flowchart illustrating a method of decoding a high frequency signal according to another embodiment of the present invention.

FIG. 10 is a flowchart illustrating a method of decoding a high frequency signal according to another embodiment of the present invention.

First, a bitstream is received and inverse multiplexed in operation 1000. In operation 1000, a coefficient, which is extracted by linear predicting a high frequency signal prepared in a domain bigger than a preset frequency, and gains, which are to adjust a signal generated by using a low frequency signal prepared in a smaller domain than the preset frequency, are inverse multiplexed.

In operation 1005, the coefficient, which is extracted by linear predicting the high frequency signal during encoding and then encoded, is decoded. In detail, an LPC coefficient of the high frequency signal may be decoded and interpolated.

In operation 1010, a synthesis filter generates an impulse response by making the coefficient decoded in operation 1005 to a filter coefficient.

In operation 1015, the impulse response generated in operation 1005 is transformed from a time domain to a frequency domain. In operation 1015, the impulse response may be transformed through a 64-point FFT. Also, the impulse response can be transformed through a transform to a frequency domain, such as an MDCT and an MDST, or a transform of a signal according to a sub band, such as a QMF and an FV-MLT.

In operation 1020, an energy level of a signal transformed in operation 1015 is normalized so that energy of the signal does not remarkably change. However, the method according to the current embodiment of the present invention may not include operation 1020.

In operation 1025, a decoded low frequency signal is received, and a residual signal is extracted by linear predicting the low frequency signal. In detail, in operation 1025, an LPC coefficient may be extracted by performing an LPC analysis on the decoded low frequency signal and then the residual signal excluding components of the LPC coefficient may be extracted from the low frequency signal.

In operation 1030, the residual signal extracted in operation 1025 is transformed from a time domain to a frequency domain by using the same transform as operation 1015. Here, the residual signal is transformed to the same points as operation 1015, and the 64-point FFT may be performed in operation 1030.

In operation 1035, a signal is generated in the high frequency band, which is a bigger domain than the preset frequency, by using the residual signal transformed in operation 1030. The signal can be generated by copying the residual signal transformed in operation 1030 in the high frequency band or by symmetrically folding the residual signal in the high frequency band based on the preset frequency.

In operation 1040, a signal is generated by calculating the signal normalized in operation 1020 and the signal generated in operation 1035 by using a preset method. Here, the preset method may be multiplication, but it is not limited thereto, and the preset method may be an operation performing multiplication, division, or combination of multiplication and division.

Operation 1045 is an inverse operation of operations 1015 and 1030, and thus the signal generated in operation 1040 is inverse transformed from the frequency domain to the time domain. Here, the signal is inverse transformed in the same points as operations 1015 and 1030. A 64-point IFFT may be performed in operation 1045.

In operation 1050, the signal inverse transformed in operation 1045 is transformed from the time domain to the frequency domain. The signal can be transformed to points different from operations 1015, 1030, and 1045, and a 288-point FFT may be performed. Also, the signal may be transformed through a transform to a frequency domain, such as an MDCT and an MDST, or a transform of a signal according to a sub band, such as a QMF and an FV-MLT.

In operation 1055, the gains are decoded according to each preset unit inverse multiplexed in operation 1030. An example of the preset unit includes a sub-frame.

In operation 1060, each gain is smoothed so that the energy value according to preset units does not remarkably change. However, the method according to the current embodiment of the present invention may not include operation 1060.

In operation 1065, the gain smoothed in operation 1060 is adjusted so that the signal does not remarkably change in the boundary of the low frequency signal and the high frequency signal. A coefficient extracted by linear predicting the low frequency signal and a coefficient extracted by linear predicting the high frequency signal decoded in operation 1005 can be used while adjusting the gain. For example, the gain may be adjusted by calculating a value to be multiplied in order to adjust the gain, and then dividing the gain smoothed in operation 1060 by the value to be multiplied. However, the method according to the current embodiment of the present invention may not include operation 1065.

In operation 1070, the gain adjusted in operation 1065 is applied to the signal transformed in operation 1050. For example, the gain is applied by multiplying the gain according to each unit adjusted in operation 1065 to the signal transformed in operation 1050.

Operation 1075 is an inverse process of the transform performed in operation 1050. The high frequency signal is restored by transforming the signal, in which the gain is applied in operation 1070, from the frequency domain to the time domain and then an overlap/add is performed. Here, operation 1075 performs inverse transform in the same points as operation 1050, and the 288-point IFFT may be performed in operation 1075.

Figure 11:
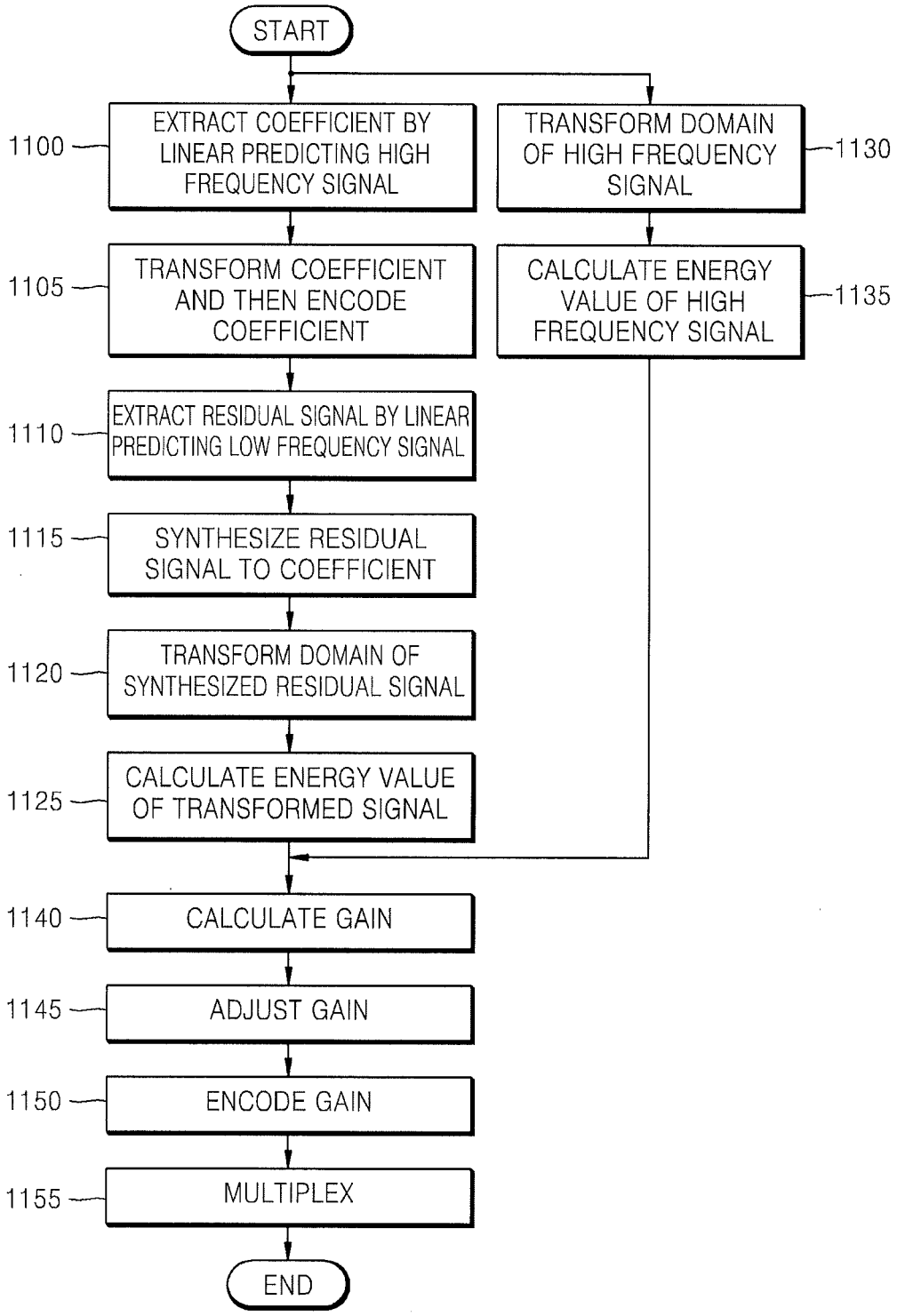
FIG. 11 is a flowchart illustrating a method of encoding a high frequency signal according to another embodiment of the present invention.

FIG. 11 is a flowchart illustrating a method of encoding a high frequency signal according to another embodiment of the present invention.

In operation 1100, a coefficient is extracted by linear predicting a high frequency signal, which is prepared in a high frequency band higher than a preset frequency. In detail, a LPC coefficient may be extracted by performing an LPC analysis on the high frequency signal, and then interpolated.

In operation 1105, the coefficient extracted in operation 1100 is transformed to a preset coefficient and then encoded. In detail, vector quantization may be performed after transforming an LPC coefficient extracted in operation 1100 to an LSF coefficient. The coefficient may also be transformed to an LSP coefficient, an ISF coefficient, or an ISP coefficient.

In operation 1100, a low frequency signal prepared in a domain smaller than the preset frequency is received, and a residual signal is extracted by linear predicting the low frequency signal. In detail, an LPC coefficient may be extracted by performing an LPC analysis on the low frequency signal and then the residual signal excluding components of the LPC coefficient may be extracted from the low frequency signal.

In operation 1115, a synthesis filter synthesis the residual signal extracted in operation 1110 by making the coefficient extracted in operation 1100 as a filter coefficient.

In operation 1120, the residual signal synthesized in operation 1115 is transformed from a time domain to a frequency domain. The residual signal may be transformed through a 288-point FFT. Also, the residual signal may be transformed through a transform to a frequency domain, such as an MDCT and an MDST, or a transform of a signal according to a sub band, such as a QMF and an FV-MLT.

In operation 1125, an energy value of the signal transformed in operation 1120 is calculated according to each preset unit. An example of the preset unit includes a sub-frame.

In operation 1130, the high frequency signal is received and transformed from the time domain to the frequency domain by using the same transform as operation 1120. Here, the high frequency signal may be transformed to the same points as operation 1120, and the 288-point FFT may be performed in operation 1130.

In operation 1135, an energy value is calculated according to preset units of the high frequency signal transformed in operation 1130. An example of the preset unit includes a sub-frame.

In operation 1140, a gain is calculated according to each preset unit by calculating a ratio between the energy value according to each unit calculated in operation 1125 and the energy value according to each unit calculated in operation 1135. The gain is calculated by dividing the energy value according to each unit calculated in operation 1135 by the energy value according to each unit calculated in operation 1125.

In operation 1145, the gain calculated in operation 1140 is adjusted so that the energy value according to each preset unit does not remarkably change. However, the method according to the current embodiment of the present invention may not include operation 1145.

In operation 1150, the gain is encoded according to each unit adjusted in operation 1145.

In operation 1155, a bitstream is generated by multiplexing the coefficient encoded in operation 1105 and the gains encoded in operation 1150.

Figure 12:
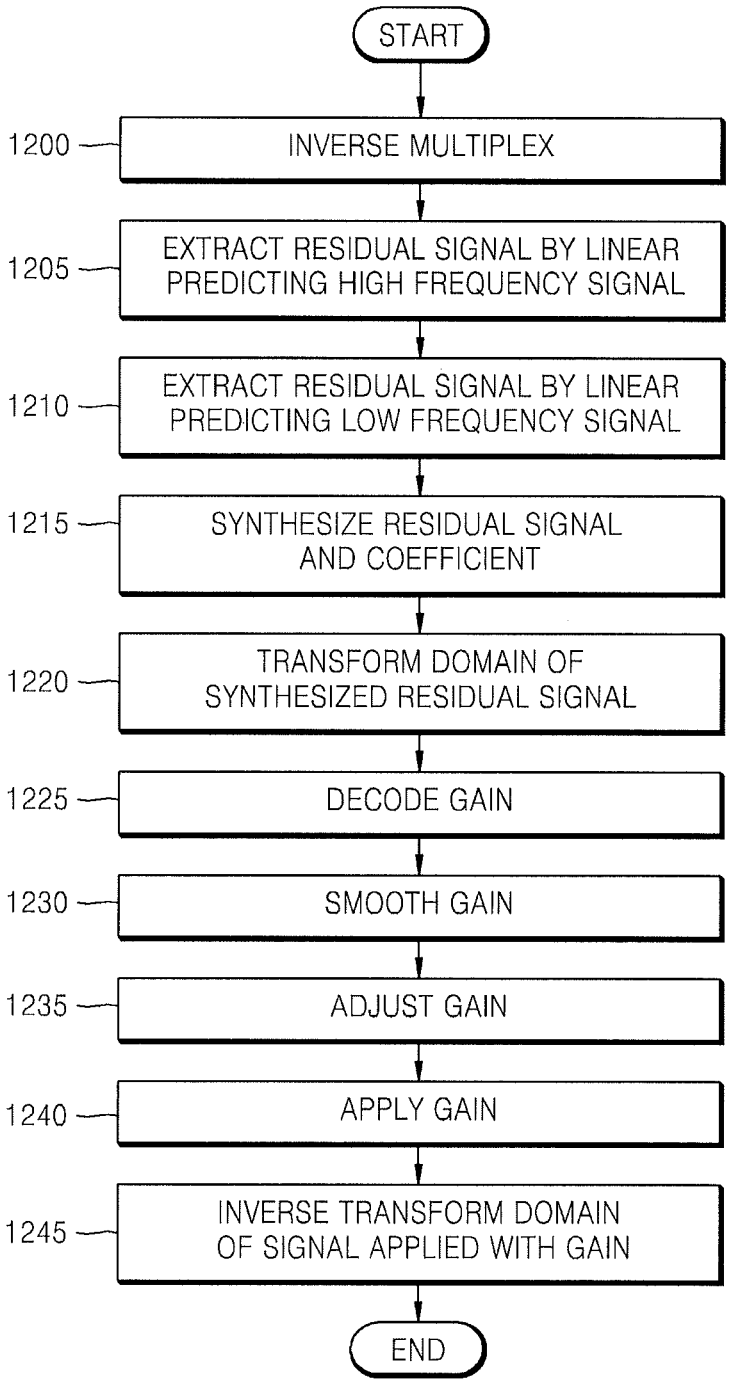
FIG. 12 is a flowchart illustrating a method of decoding a high frequency signal according to another embodiment of the present invention.

FIG. 12 is a flowchart illustrating a method of decoding a high frequency signal according to another embodiment of the present invention.

First, a bitstream is received from an encoding terminal and inverse multiplexed in operation 1200. In operation 1200, a coefficient, which is extracted by linear predicting a high frequency signal prepared in a domain bigger than a preset frequency, and gains, which are to adjust a signal generated by using a low frequency signal prepared in a smaller domain than the preset frequency, are inverse multiplexed.

In operation 1205, the coefficient, which is extracted by linear predicting the high frequency signal during encoding and then encoded, is decoded. In detail, an LPC coefficient of the high frequency signal may be decoded and interpolated.

In operation 1210, a decoded low frequency signal is received, and a residual signal is extracted by linear predicting the low frequency signal. In detail, an LPC coefficient may be extracted by performing an LPC analysis on the decoded low frequency signal and then the residual signal excluding components of the LPC coefficient may be extracted from the low frequency signal.

In operation 1215, a synthesis filter synthesis the residual signal extracted in operation 1210 by making the coefficient decoded in operation 1205 as a filter coefficient.

In operation 1220, the residual signal synthesized in operation 1215 is transformed from a time domain to a frequency domain. The residual signal may be transformed through a 288-point FFT.

In operation 1225, the gains inverse multiplexed in operation 1200 are decoded according to each preset unit. An example of the preset unit includes a sub-frame.

In operation 1230, each gain decoded in operation 1225 is smoothed so that the energy between preset units does not remarkably change. However, the method according to the current embodiment of the present invention may not include operation 1230.

In operation 1235, the gain smoothed in operation 1230 is adjusted so that the signal does not remarkably change in the boundary of the low frequency signal and the high frequency signal. In operation 1235, a coefficient extracted by linear predicting the decoded low frequency signal and a coefficient extracted by linear predicting the high frequency signal decoded in operation 1205 may be used while adjusting the gain. For example, the gain can be adjusted by calculating a value to be multiplied in order to adjust the gain, and then dividing the gain smoothed in operation 1240 by the value to be multiplied. However, the method according to the current embodiment of the present invention may not include operation 1235.

In operation 1240, the gain adjusted in operation 1235 is applied to the signal transformed in operation 1220. For example, the gain is applied by multiplying the gain according to each unit adjusted in operation 1235 to the signal transformed in operation 1220.

Operation 1245 is an inverse process of the transform pf operation 1220. In operation 1245, the high frequency signal is restored by transforming the signal, in which the gain is applied in operation 1240, from the frequency domain to the time domain and an overlap/add is performed. Here, the high frequency signal is transformed to the same points as operation 1220, and the 288-point IFFT may be performed in operation 1245.

The invention can also be embodied as computer readable codes on a computer readable recording medium, including all devices having an information processing function. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices, While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for encoding a high band signal, the apparatus comprising:

a processor configured:

to extract a coefficient from linear prediction of a high band signal, and to encode the extracted coefficient;

to generate a signal based on a low band signal and the extracted coefficient; and to obtain a gain from an energy value of the high band signal and an energy value of the generated signal and to encode the gain; and an output unit configured to transmit the encoded coefficient and the encoded gain to a decoder, wherein the processor is configured to encode the extracted coefficient by performing an interpolation process on the extracted coefficient.

2. The apparatus of claim 1, wherein the processor is configured:

to generate a first signal by using the extracted coefficient;

to generate a second signal in a high band by using the low band signal; and to generate a third signal by calculating the first and second signals in a predetermined method.

3. The apparatus of claim 1, wherein the processor is configured:

to generate a first signal by using the extracted coefficient;

to extract a residual signal by linear predicting the low band signal;

to generate a second signal in a high band by using the extracted residual signal; and to generate a third signal by calculating the first and second signals by using a preset method.

4. The apparatus of claim 2, wherein the processor is configured:

to generate a fourth signal by using the extracted coefficient; and to generate the first signal by normalizing the fourth signal.

5. The apparatus of claim 2, wherein the processor is configured to generate the second signal and the third signal in a frequency domain.

6. The apparatus of claim 1, wherein the processor is configured:

to extract a residual signal by linear predicting the low band signal;

to synthesize the extracted residual signal and the extracted coefficient; and to generate the signal by calculating the synthesized residual signal and the high band signal by using a preset method.

7. The apparatus of claim 6, wherein the processor is configured to generate the signal in a frequency domain.

8. The apparatus of claim 1, wherein the processor is configured further to adjust each of the calculated ratios by using a ratio of tonality of the low band signal to tonality of the high band signal.

9. An apparatus for generating a high band signal, the apparatus comprising:

a receiving unit configured to receive a bitstream including an encoded coefficient and an encoded gain; and a processor configured to:

to decode the encoded coefficient obtained from linear prediction of a high band signal, and an encoded low band signal from the bitstream, and to generate a signal based on the decoded coefficient and the decoded low band signal;

to decode the encoded gain corresponding to a ratio between an energy value the generated signal and an energy value of the high band signal from the bitstream; and to adjust the generated signal using the decoded gain and the decoded coefficient, wherein the processor is configured to decode the encoded coefficient in consideration of an interpolation process.

10. The apparatus of claim 9, wherein the processor is configured:

to generate a first signal by decoding the encoded coefficient;

to generate a second signal in a high band by using the decoded low band signal; and to generate a third signal by calculating the first and second signals by using a preset method.

11. The apparatus of claim 9, wherein the processor is configured to:

to generate a first signal by decoding the encoded coefficient;

to extract a residual signal by linear predicting the decoded low band signal;

to generate a second signal in a high band by using the extracted residual signal; and to generate a third signal by calculating the first and second signals by using a preset method.

12. The apparatus of claim 10, wherein the processor is configured to:

to generate a fourth signal by using the decoded coefficient; and to generate the first signal by normalizing the fourth signal.

13. The apparatus of claim 10, wherein the processor is configured to generate the second signal and the third signal a frequency domain.

14. The apparatus of claim 11, wherein the processor is configured to:

to generate a fourth signal by using the decoded coefficient; and to generate the first signal by normalizing the fourth signal.

15. The apparatus of claim 9, wherein the processor is configured to:

to decode the encoded coefficient and the encoded low band signal;

to extract a residual signal by linear predicting the decoded low band signal; and to synthesize the extracted residual signal and the decoded coefficient.

16. The apparatus of claim 15, wherein the processor is configured to adjust the generated signal in a frequency domain.

17. The apparatus of claim 9, wherein the processor is configured to further adjust the ratio so that the signal does not remarkably change in the boundary of the decoded low band signal and the high band signal that is to be decoded.

18. The apparatus of claim 9, wherein the processor is configured to:

to generate a first signal by decoding the encoded coefficient;

to extract a residual signal by decoding and linear predicting the encoded low band signal; and to generate a second signal by calculating the first signal and the extracted residual signal by using a preset method.

* * * * *